US011156215B2

(12) United States Patent
Oroojloo et al.

(10) Patent No.: US 11,156,215 B2
(45) Date of Patent: Oct. 26, 2021

(54) HYDRAULIC-POWERED AIR COMPRESSOR

(71) Applicants: Mohammad Oroojloo, Karaj (IR); Sajad Onsori, Karaj (IR); Niloofar Oroojloo, Karaj (IR); Pooya Oroojloo, Karaj (IR); Ali Oroojloo, Karaj (IR)

(72) Inventors: Mohammad Oroojloo, Karaj (IR); Sajad Onsori, Karaj (IR); Niloofar Oroojloo, Karaj (IR); Pooya Oroojloo, Karaj (IR); Ali Oroojloo, Karaj (IR)

(73) Assignee: MOJAHAZ SHAHRIAR TECHNICAL ENGINEERING SERVICE .CO, LTD, Tehran (IR)

( * ) Notice: Subject to any disclaimer, the term of this patent is extended or adjusted under 35 U.S.C. 154(b) by 144 days.

(21) Appl. No.: 16/252,585

(22) Filed: Jan. 19, 2019

(65) Prior Publication Data

US 2019/0154023 A1 May 23, 2019

Related U.S. Application Data

(60) Provisional application No. 62/619,205, filed on Jan. 19, 2018.

(51) Int. Cl.

| | |
|---|---|
| ***F04B 35/00*** | (2006.01) |
| ***F04B 39/08*** | (2006.01) |
| ***F04B 39/00*** | (2006.01) |

(52) U.S. Cl.

CPC ..... *F04B 35/008* (2013.01); *F04B 39/0016* (2013.01); *F04B 39/08* (2013.01); *F04B 2203/12* (2013.01)

(58) Field of Classification Search

CPC ..... F04B 9/113; F04B 9/133; F04B 27/00; F04B 27/005; F04B 35/00; F04B 35/002;

(Continued)

(56) References Cited

U.S. PATENT DOCUMENTS

| | | | | |
|---|---|---|---|---|
| 4,072,210 | A * | 2/1978 | Chien | F04B 37/02 184/5 |
| 6,537,039 | B2 * | 3/2003 | Mann | F04B 9/08 137/565.18 |
| 2017/0284388 | A1 * | 10/2017 | Caldwell | F04B 1/063 |

FOREIGN PATENT DOCUMENTS

JP 2000186667 A * 7/2000

* cited by examiner

*Primary Examiner* — Charles G Freay
*Assistant Examiner* — Chirag Jariwala
(74) *Attorney, Agent, or Firm* — Bajwa IP Law Firm; Haris Zaheer Bajwa

(57) ABSTRACT

A portable hydraulic-powered air compressor system detachably connected to a hydraulic power system of a vehicle may include a reciprocating compressor. The reciprocating compressor may include a compression cylinder, and a compressor piston assembly that may be movably disposed within the compression cylinder. Opposite sides of the compressor piston assembly may respectively define a rod chamber and a front chamber in an interior of the compression cylinder. The front chamber may include an air intake port. The compressor piston assembly may include a one-way valve that may be configured to fluidically connect the rod chamber and the front chamber in response to an air pressure in the front chamber being higher than an air pressure in the rod chamber. The hydraulic-powered air compressor system may further include a hydraulic actuating mechanism detachably connected to the hydraulic power system. The hydraulic actuating mechanism may be coupled to a piston rod of the compressor piston and may be configured to drive a reciprocating motion of the compressor piston within the compression cylinder.

16 Claims, 15 Drawing Sheets

(58) Field of Classification Search
CPC .... F04B 35/008; F04B 35/06; F04B 39/0016; F04B 41/06; F04B 1/02; F04B 5/02; F04B 7/04; F04B 9/109–9/1178; F04B 39/08; F04B 2203/12
USPC ..... 417/256, 259, 375, 396, 397, 403, 404; 91/422
See application file for complete search history.

20

Section B-B

HYDRAULIC-POWERED AIR COMPRESSOR

CROSS-REFERENCE TO RELATED APPLICATION

This application claims the benefit of priority from U.S. Provisional Patent Application Ser. No. 62/619,205, filed on Jan. 19, 2018, and entitled "HYDRAULIC DIRECT-DRIVE AIR COMPRESSOR," which is incorporated herein by reference in its entirety.

TECHNICAL FIELD

The present disclosure relates to air compressors, and particularly relates to hydraulic-powered portable air compressors.

BACKGROUND

Tractor drivers and other agricultural and construction vehicle drivers have a constant need for compressed air sources. It is advantageous to have compressed air available in the vehicle for cleaning air filters, adding air to tires, blowing out radiators, and operating air tools such as wrenches.

Air compressors may be mounted on vehicles to provide the needed compressed air. Such air compressors may be powered by electrical systems of the vehicle or they may be driven by the vehicle engine via either a belt-and-pulley mechanism or via a power-take-off (PTO) shaft. Air compressors that are electrically powered by electrical systems of a vehicle have generally limited capacity and are not capable of providing compressed air with sufficient volume and pressure for effectively operating power tools such as air wrenches. A permanently-mounted air compressor on a vehicle that is driven by the vehicle engine via a belt-and-pulley mechanism reduces the engine power and increases the fuel consumption and harmful emissions. A PTO shaft may not be used simultaneously for driving a permanently-mounted air compressor and other agricultural implements.

For an effective operation, an air compressor includes an air reservoir, which takes up a lot of space in the vehicle. There is, therefore, a need for a high-capacity, compact, and light-weight air compressor that is capable of supplying compressed air with sufficient volume and pressure without a need for an air reservoir or a need for the compressor to be permanently mounted on the vehicle. There is further a need for an air compressor capable of being temporarily powered and being easily mounted and unmounted.

SUMMARY

This summary is intended to provide an overview of the subject matter of the present disclosure, and is not intended to identify essential elements or key elements of the subject matter, nor is it intended to be used to determine the scope of the claimed implementations. The proper scope of the present disclosure may be ascertained from the claims set forth below in view of the detailed description below and the drawings.

According to one or more exemplary embodiments, the present disclosure is directed to a portable hydraulic-powered air compressor system detachably connected to a hydraulic power system of a vehicle. The exemplary hydraulic-powered air compressor system may include a reciprocating compressor. The exemplary reciprocating compressor may include a compression cylinder, and a compressor piston assembly that may be movably disposed within the compression cylinder. Opposite sides of the compressor piston assembly may respectively define a rod chamber and a front chamber in an interior of the compression cylinder. The front chamber may include an air intake port. The exemplary compressor piston assembly may include a one-way valve that may be configured to fluidically connect the rod chamber and the front chamber in response to an air pressure in the front chamber being higher than an air pressure in the rod chamber. The exemplary hydraulic-powered air compressor system may further include a hydraulic actuating mechanism detachably connected to the hydraulic power system. The exemplary hydraulic actuating mechanism may be coupled to a piston rod of the compressor piston and may be configured to drive a reciprocating motion of the compressor piston within the compression cylinder.

According to an exemplary embodiment, the exemplary compressor piston assembly may include a compressor piston that may be slidably mounted within the compression cylinder. The compressor piston may be a disc-shaped piston with a circular recess and a central hole within the circular recess concentric with the circular recess. The disc-shaped piston may further include an annular recess between an outer periphery of the central hole and an inner periphery of the central recess, such that an annular step may be formed at a boundary between the annular recess and the circular recess. The annular recess may include at least one aperture that may be connected in fluid communication with the rod chamber. The exemplary compressor piston assembly may further include a valve disc with a larger-diameter disc portion and a smaller-diameter disc portion that may be attached to a disc stem. The disc-shaped piston may be mounted on the smaller-diameter disc portion between the larger-diameter disc portion and the disc stem, where an inner surface of the central hole may slidably encompass an outer surface of the smaller-diameter disc. The disc stem may be coupled with the piston rod. A length of the outer surface of the smaller-diameter disc portion may be larger than a length of the inner surface of the central hole. The disc-shaped piston may be configured to be slidable over the outer surface of the smaller-diameter disc portion between a first position and a second position along an axis parallel to the piston rod responsive to an air pressure difference between the front chamber and the rod chamber.

In an exemplary embodiment, the larger-diameter disc portion may be placed within the circular recess, where a diameter of the larger diameter-disc portion may be smaller than a diameter of the circular recess, as a result a circular slit may form between an outer periphery of the larger-diameter disc portion and an inner periphery of the circular recess.

In an exemplary embodiment, the disc-shaped piston may move to the first position responsive to an air pressure within the rod chamber being higher than an air pressure within the front chamber. In the first position, the larger-diameter disc portion may be placed within the circular recess and may be tightly pressed against and engaged with the annular step at the boundary between the annular recess and the circular recess and as a result disconnecting a fluid communication between the annular recess and the front chamber.

In an exemplary embodiment, the disc-shaped piston may move to the second position responsive to an air pressure within the front chamber being higher than an air pressure within the rod chamber. In the second position, the larger-diameter disc portion may be placed within the circular recess and may be disengaged from the annular step, and as a result the circular slit may connect the annular recess and the front chamber in fluid communication.

In an exemplary embodiment, the disc stem may include an externally threaded rod and the piston rod may include an internally threaded annular rod. The disc stem may be tightly screwed into the piston rod.

In an exemplary embodiment, the hydraulic actuating mechanism may include a radial-piston hydraulic motor that may be configured to be driven by the hydraulic power system of the vehicle, a directional control valve that may be attached to the radial-piston hydraulic motor, where the radial-piston hydraulic motor may be configured to actuate the directional control valve, and a double-acting cylinder that may be connected in fluid communication with the hydraulic power system via the directional control valve. The double-acting cylinder may include a hydraulic piston that may be disposed within the double-acting cylinder. The hydraulic piston may be coupled to the piston rod of the compressor piston and drive a reciprocating motion of the compressor piston within the compression cylinder.

In an exemplary embodiment, the double-acting cylinder may be coaxially disposed within a housing with a hollow space between an internal surface of the housing and the external surface of the double-acting cylinder. The hollow space may be connected in fluid communication with the rod chamber of the reciprocating compressor.

In an exemplary embodiment, the hollow space may include an unloading passageway that may be controlled by a pressure relief valve. The pressure relief valve may be set at a predetermined value of pressure and may be configured to exhaust compressed air accumulated in the connected hollow space and the rod chamber via the unloading passageway responsive to an air pressure within the connected hollow space and the rod chamber being higher that the predetermined value of pressure.

In an exemplary embodiment, the hollow space may further include a compressed air outlet port that may be connected to an air hose for supplying compressed air to a user.

In an exemplary embodiment, opposite sides of the hydraulic piston may respectively define a first chamber and a second chamber in an interior of the double-acting cylinder. The hydraulic piston may be configured to be movable in two directions responsive to relative magnitudes of hydraulic oil pressure in the first chamber and the second chamber.

In an exemplary embodiment, the directional control valve may include a cylindrical valve housing. The cylindrical valve housing may include a first working port and a second working port oppositely disposed along a periphery of the cylindrical valve housing. The first working port may be connected in fluid communication with the first chamber and the second working port may be connected in fluid communication with the second chamber. The directional control valve may further include a valve element rotatably and coaxially mounted within the cylindrical valve housing. The valve element may include a cylindrical body with a first recess and a second recess oppositely disposed along a periphery of the cylindrical body. The valve element may be coupled to the radial-piston hydraulic motor.

In an exemplary embodiment, the first recess may include a first flow channel in fluid communication with an oil pump of the hydraulic power system of the vehicle via a pressure line. The second recess may include a second flow channel in fluid communication with an oil tank of the hydraulic power system of the vehicle via a tank line.

In an exemplary embodiment, the radial-piston hydraulic motor may be configured to drive a rotational movement of the valve element within the cylindrical valve housing alternately placing the first recess and the second recess in fluid communication with a corresponding one of the first working port and the second working port.

In an exemplary embodiment, the air intake port may be controlled by a one-way valve that may be configured to allow ambient air to be drawn into the front chamber via the air intake port and to prevent compressed air to be discharged out of the front chamber via the air intake port.

BRIEF DESCRIPTION OF THE DRAWINGS

The drawing figures depict one or more implementations in accord with the present teachings, by way of example only, not by way of limitation. In the figures, like reference numerals refer to the same or similar elements.

DETAILED DESCRIPTION

In the following detailed description, numerous specific details are set forth by way of examples to provide a thorough understanding of the relevant teachings related to the exemplary embodiments. However, it should be apparent that the present teachings may be practiced without such details. In other instances, well known methods, procedures, components, and/or circuitry have been described at a relatively high-level, without detail, in order to avoid unnecessarily obscuring aspects of the present teachings.

The following detailed description is presented to enable a person skilled in the art to make and use the methods and devices disclosed in exemplary embodiments of the present disclosure. For purposes of explanation, specific nomenclature is set forth to provide a thorough understanding of the present disclosure. However, it will be apparent to one skilled in the art that these specific details are not required to practice the disclosed exemplary embodiments. Descriptions of specific exemplary embodiments are provided only as representative examples. Various modifications to the exemplary implementations will be plain to one skilled in the art, and the general principles defined herein may be applied to other implementations and applications without departing from the scope of the present disclosure. The present disclosure is not intended to be limited to the implementations shown, but is to be accorded the widest possible scope consistent with the principles and features disclosed herein.

Figure 1:
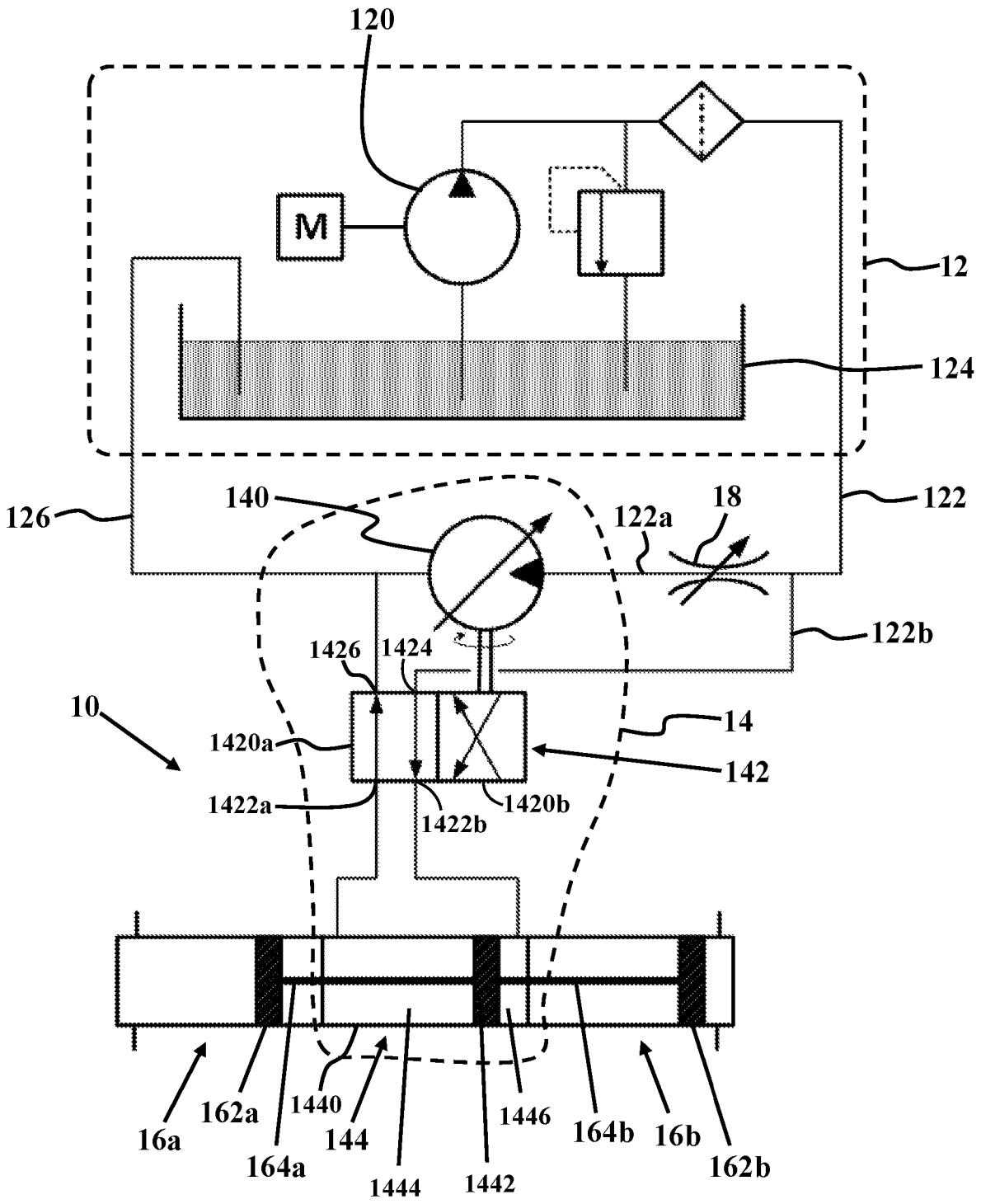
FIG. 1 illustrates a hydraulic circuit of a hydraulic-powered air compressor system connected to a hydraulic power system of a vehicle, consistent with one or more exemplary embodiments of the present disclosure.

FIG. 1 illustrates a hydraulic circuit of a hydraulic-powered air compressor system 10 that may be connected to a hydraulic power system 12 of a vehicle, consistent with one or more exemplary embodiments of the present disclosure. In an exemplary embodiment, air compressor system 10 may include a hydraulic actuation mechanism 14 that may be detachably connected to and be driven by hydraulic power system 12. In an exemplary embodiment, air compressor system 10 may further include air compressors 16*a-b* that may be coupled to and be driven by hydraulic actuation mechanism 14.

In an exemplary embodiment, pressurized oil may be provided by pump 120 in a pressure line 122 that may be connected to a hydraulic motor 140 via a line 122*a* intercepted by a throttle valve 18. Pressurized oil may drive hydraulic motor 140, and throttle valve 18 may be utilized to regulate the speed of hydraulic motor 140 by restricting the pressurized oil flow into hydraulic motor 140. In an exemplary embodiment, hydraulic motor 140 may be coupled to a hydraulic directional valve 142 and may be configured to actuate hydraulic directional valve 142 between two valve positions 1420*a-b*.

In an exemplary embodiment, hydraulic directional valve 142 may be a four-port two-position hydraulic directional valve that may include two working ports 1422*a-b*, a pressure port 1424, and a tank port 1426. In an exemplary embodiment, pressurized oil provided by hydraulic power system 12 may be sent through hydraulic directional valve 142 to a double-acting hydraulic cylinder 144. Double-acting hydraulic cylinder 144 may be configured to be driven in a reciprocating motion by the pressurized oil sent to double-acting hydraulic cylinder 144 via hydraulic directional valve 142.

In an exemplary embodiment, double-acting hydraulic cylinder 144 may include a hydraulic piston 1442 that may be movably disposed within a hydraulic cylinder 1440. Opposite sides of hydraulic piston 1442 may respectively define, in an interior of hydraulic cylinder 1440, a first chamber 1444, and a second chamber 1446. Hydraulic piston 1442 may be moveable in two directions in response to relative magnitudes of hydraulic oil pressure in first chamber 1444 and second chamber 1446. For example, when pressurized oil enters first chamber 1444, the magnitude of pressure in first chamber 1444 is higher than the magnitude of pressure in second chamber 1446, as a result, hydraulic piston 1442 moves towards the right and when pressurized oil enters second chamber 1446, the magnitude of pressure in second chamber 1446 is higher than the magnitude of pressure in first chamber 1444, as a result, hydraulic piston 1442 moves towards the left.

In an exemplary embodiment, pressure line 122 may be connected to pressure port 1424 of hydraulic directional valve 142 via a line 122*b*, and tank port 1426 may be connected to a tank 124 of hydraulic power system 12 via a tank line 126. In an exemplary embodiment, working port 1422*a* may be connected to first chamber 1444 and working port 1422*b* may be connected to second chamber 1446.

In an exemplary embodiment, when hydraulic directional valve 142 is actuated by hydraulic motor 140 into valve position 1420*a*, working port 1422*a* may be connected to tank port 1426 and may connect first chamber 1444 to tank line 126 and working port 1422*b* may be connected to pressure port 1424 and may connect second chamber 1446 to pressure line 122. As a result, pressurized oil may be sent to second chamber 1446 which in turn may force hydraulic cylinder 1442 to slide toward left within hydraulic cylinder 1440.

In an exemplary embodiment, when hydraulic directional valve 142 is actuated by hydraulic motor 140 into valve position 1420*b*, working port 1422*b* may be connected to tank port 1426 and may connect second chamber 1446 to tank line 126, and working port 1422*a* may be connected to pressure port 1424 and may connect first chamber 1444 to pressure line 122. As a result, pressurized oil may be sent to first chamber 1444 which in turn may force hydraulic cylinder 1442 to slide toward right within hydraulic cylinder 1440. In an exemplary embodiment, hydraulic motor 140 may be configured to actuate hydraulic directional valve 142 such that hydraulic directional valve 142 may alternately shift between valve positions 1420*a* and 1420*b* and alternately send the pressurized oil into first chamber 1444 and second chamber 1446 of double-acting hydraulic cylinder 144 driving the reciprocating motion of hydraulic piston 1442 back and forth within hydraulic cylinder 1440.

In an exemplary embodiment, hydraulic piston 1442 may be coupled to compressor pistons 162*a-b* of air compressors 16*a-b* by piston rods 164*a-b*. As hydraulic piston 1442 moves back and forth within hydraulic cylinder 1440, reciprocating motion of hydraulic piston 1442 may be transferred to compressor pistons 162*a-b* via piston rods 164*a-b*. In an exemplary embodiment, one air compressor, for example either air compressor 16*a* or air compressor 16*b* may be coupled to double-acting hydraulic cylinder 144.

Figure 2A:
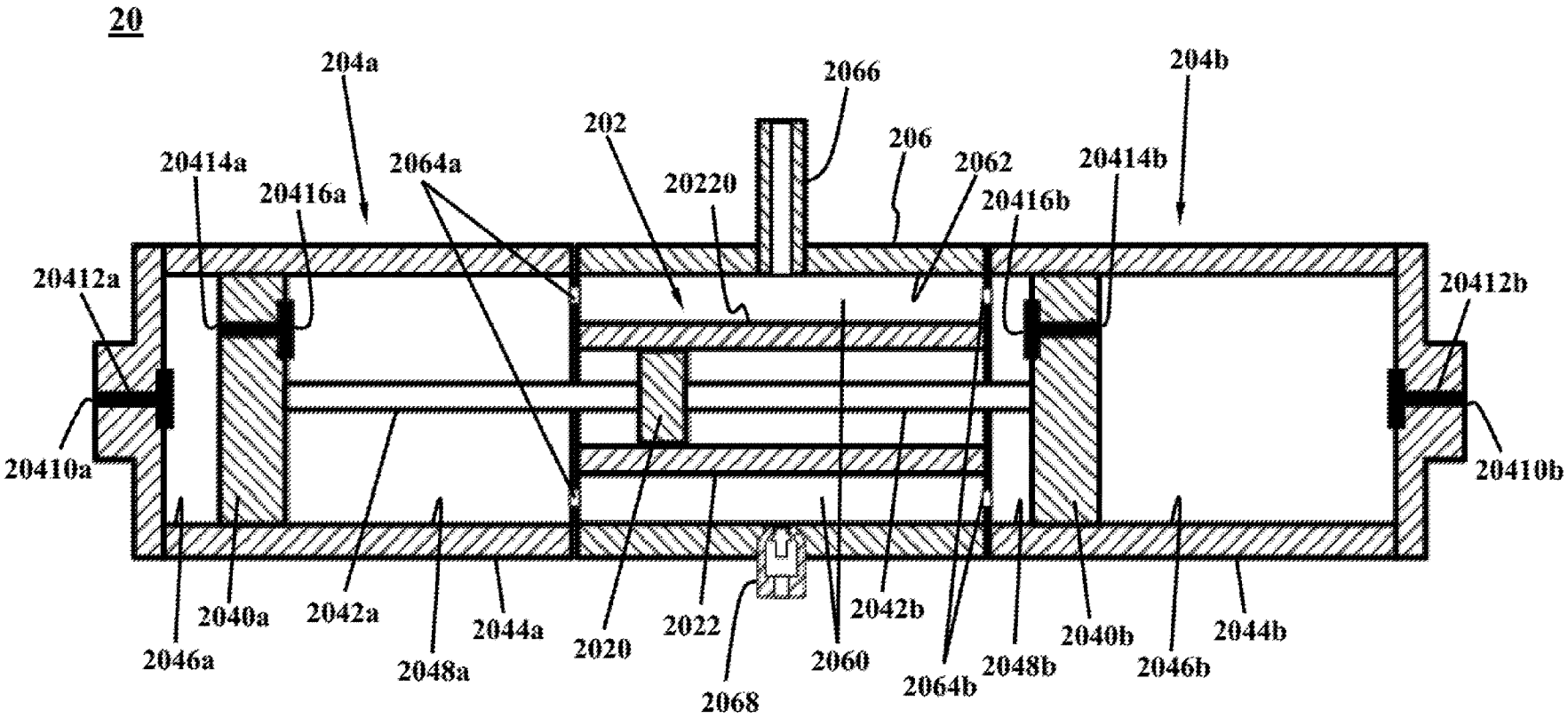
FIG. 2A illustrates a sectional top-view of a hydraulic-powered air compressor, consistent with one or more exemplary embodiments of the present disclosure.
Figure 2B:
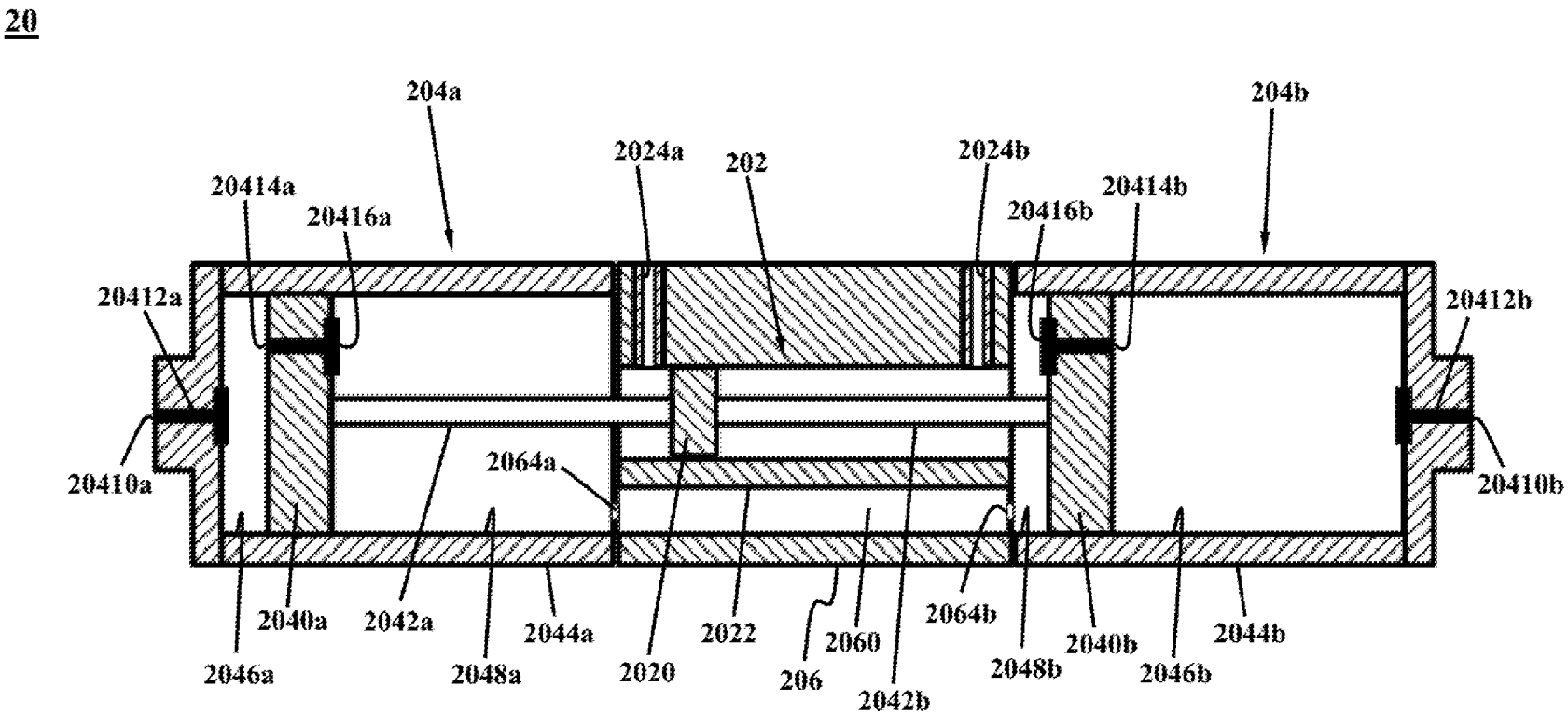
FIG. 2B illustrates a sectional side-view of a hydraulic-powered air compressor, consistent with one or more exemplary embodiments of the present disclosure.
Figure 2C:
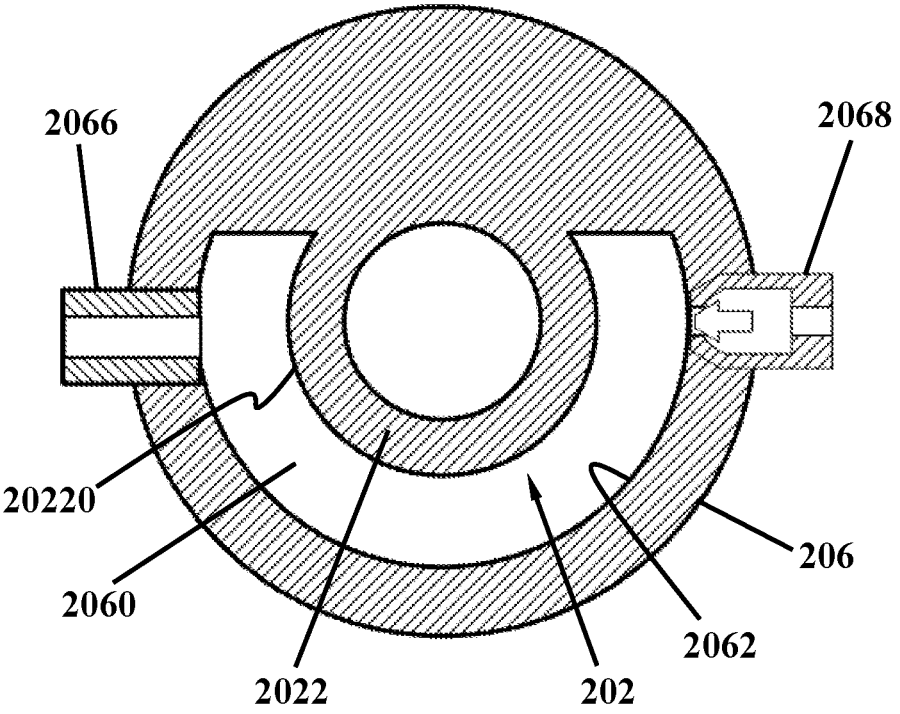
FIG. 2C illustrates a sectional front-view of a hydraulic-powered air compressor, consistent with one or more exemplary embodiments of the present disclosure.

FIG. 2A illustrates a sectional top-view of a hydraulic-powered air compressor 20, consistent with one or more exemplary embodiments of the present disclosure, FIG. 2B illustrates a sectional side-view of a hydraulic-powered air compressor 20, consistent with one or more exemplary embodiments of the present disclosure, and FIG. 2C illustrates a sectional front-view of a hydraulic-powered air compressor 20, consistent with one or more exemplary embodiments of the present disclosure.

Referring to FIGS. 1 and 2A-2C, in an exemplary embodiment, hydraulic-powered air compressor 20 may include a double-acting hydraulic cylinder 202 similar to double-acting hydraulic cylinder 144. In an exemplary embodiment, double-acting hydraulic cylinder 202 may include a hydraulic piston 2020 similar to hydraulic piston 1442 that may be moveably disposed within a hydraulic cylinder 2022 similar to hydraulic cylinder 144. In an exemplary embodiment, hydraulic cylinder 2022 may include cylinder ports 2024*a-b* at either side of hydraulic piston 2020. Cylinder ports 2024*a-b* may be connected in fluid communication to a hydraulic pressure source similar to pressure line 122 and a tank similar to tank 124 via a hydraulic directional control valve similar to hydraulic directional valve 142. In an exemplary embodiment, cylinder ports 2024*a-b* may be connected to working ports 1422*a-b* of hydraulic directional valve 142 and hydraulic directional valve 142 may be configured to alternately send pressurized oil into hydraulic cylinder 2022 via cylinder ports 2024*a-b* and drive the reciprocating motion of hydraulic piston 2020 within hydraulic cylinder 2022.

In an exemplary embodiment, hydraulic-powered air compressor 20 may include two reciprocating air compressors 204*a-b* similar to air compressors 16*a-b* mounted on either side of double-acting hydraulic cylinder 202. In an exemplary embodiment, the reciprocating motion of hydraulic piston 2020 may be transferred to compressor pistons 2040*a-b* of reciprocating air compressors 204*a-b* by piston rods 2042*a-b* and compressor pistons 2040*a-b* may move back and forth in reciprocating motions within respective compression cylinders 2044*a-b*.

In an exemplary embodiment, each reciprocating air compressor, for example, reciprocating air compressor 204*a* may include compressor piston 2040*a* that may be moveably disposed within compression cylinder 2044*a* and may have a reciprocating motion within compression cylinder 2044*a*, as was described in the preceding paragraphs.

In an exemplary embodiment, opposite sides of compressor piston 2040*a* may respectively define a front chamber 2046*a* and a rod chamber 2048*a* in an interior of compression cylinder 2044*a*. In an exemplary embodiment, compression cylinder 2044*a* may include an air intake port 20410*a* that may open into front chamber 2046*a* and may be controlled by an intake one-way valve 20412*a*. Intake one-way valve 20412*a* may be configured to allow ambient air to be only drawn from surrounding environment into front chamber 2046*a*.

In an exemplary embodiment, reciprocating air compressor 204*b* may be structurally similar to reciprocating air compressor 204*a*. Reciprocating air compressor 204*b* may include compressor piston 2040*b* that may be moveably disposed within compression cylinder 2044*b* and may have a reciprocating motion within compression cylinder 2044*b*, as was described in the preceding paragraphs.

In an exemplary embodiment, opposite sides of compressor piston 2040*b* may respectively define a front chamber 2046*b* and a rod chamber 2048*b* in an interior of compression cylinder 2044*b*. In an exemplary embodiment, compression cylinder 2044*b* may include an air intake port 20410*b* that may open into front chamber 2046*b* and may be controlled by an intake one-way valve 20412*b*. Intake one-way valve 20412*b* may be configured to allow ambient air to be only drawn from surrounding environment into front chamber 2046*b*.

In an exemplary embodiment, hydraulic-powered air compressor 20 may further include a housing 206 that may be a cylinder-shaped housing surrounding hydraulic cylinder 2022. In an exemplary embodiment, housing 206 may surround hydraulic cylinder 2022, such that there may be a hollow space 2060 between an internal surface 2062 of housing 206 and an external surface 20220 of hydraulic cylinder 2022. In an exemplary embodiment, hydraulic cylinder 2022 may be mounted in or be integrally formed with housing 206.

In an exemplary embodiment, each compressor piston, for example, compressor piston 2040*a* may further include an opening 20414*a* that may fluidically connect front chamber 2046*a* and rod chamber 2048*a*. The opening 20414*a* may be controlled by a one-way valve 20416*a* that may be mounted on compressor piston 2040*a*. In an exemplary embodiment, one-way valve 20416*a* may be configured to fluidically connect front chamber 2046*a* and rod chamber 2048*a* in response to an air pressure in front chamber 2046*a* being higher than a threshold. In an exemplary embodiment, the threshold may be set such that when the air pressure in front chamber 2046*a* is higher than an air pressure in rod chamber 2048*a*, one-way valve 20416*a* may allow pressurized air to flow from front chamber 2046*a* through opening 20414*a* into rod chamber 2048*a*.

In an exemplary embodiment, compressor piston 2040*b* may be structurally similar to compressor piston 2040*a* and may include an opening 20414*b* that may fluidically connect front chamber 2046*b* and rod chamber 2048*b*. The opening 20414*b* may be controlled by a one-way valve 20416*b* that may be mounted on compressor piston 2040*b*. In an exemplary embodiment, one-way valve 20416*b* may be configured to fluidically connect front chamber 2046*b* and rod chamber 2048*b* in response to an air pressure in front chamber 2046*b* being higher than a threshold. In an exemplary embodiment, the threshold may be set such that when the air pressure in front chamber 2046*b* is higher than an air pressure in rod chamber 2048*b*, one-way valve 20416*b* may allow pressurized air to flow from front chamber 2046*b* through opening 20414*b* into rod chamber 2048*b*.

In an exemplary embodiment, rod chamber 2048*a* may be connected in fluid communication with hollow space 2060 via one or more apertures 2064*a* and rod chamber 2048*b* may be connected in fluid communication with hollow space 2060 via one or more apertures 2064*b*. In exemplary embodiments, this fluid communication between hollow space 2060 and rod chambers 2048*a-b* may allow for accumulating compressed air within hollow space 2060 until the compressed air is discharged and used by a user. In exemplary embodiments, the fluid communication between hollow space 2060 and rod chambers 2048*a-b* may further allow for eliminating a need for an external air reservoir that may take up a lot of space in a vehicle.

In an exemplary embodiment, housing 206 may include a compressed air outlet port 2066 that may be utilized to discharge the compressed air accumulated within hollow space 2060. In an exemplary embodiment, air outlet port 2066 may be connected to an air hose to provide a user with pressurized air.

In an exemplary embodiment, housing 206 may further be equipped with a pressure relief valve 2068 that may be set at a predetermined value of pressure and when the air pressure in hollow space 2060 is higher than the predetermined value of pressure, pressure relief valve 2068 may allow excess compressed air to exit hollow space 2060 until the air pressure within hollow space 2060 is lower than the set predetermined value of pressure.

Referring to FIG. 2B, in an exemplary embodiment, when pressurized hydraulic oil is pumped into double-acting hydraulic cylinder 202 via cylinder port 2024*a*, hydraulic piston 2020 may move towards right and this movement is transferred to both compressor pistons 2040*a-b*. When hydraulic piston 2020 moves towards right, it may drag compressor piston 2040*a* in a retraction stroke toward rod chamber 2048*a*. Intake one-way valve 20412*a* may open opening 20410*a* under a suction force created by the retraction stroke of compressor piston 2040*a* and ambient air may enter front chamber 2046*a*. Concurrently, when hydraulic piston 2020 moves toward right, it may push compressor piston 2040*b* in an extension stroke into front chamber 2046*b*. The air within front chamber 2046*b* may be compressed and as a result the air pressure in front chamber 2046*b* increases. When the air pressure in front chamber 2046*b* exceeds the air pressure in rod chamber 2048*b*, one-way valve 20416*b* may open opening 20414*b* and may allow compressed air to flow from front chamber 2046*b* into rod chamber 2048*b* until the air pressure in front chamber 2046*b* is not higher that air pressure in rod chamber 2048*b* anymore. The compressed air may then be accumulated in interconnected rod chambers 2048*a-b* and hollow space 2060.

In an exemplary embodiment, when pressurized hydraulic oil is pumped into double-acting hydraulic cylinder 202 via cylinder port 2024*b*, hydraulic piston 2020 may move toward left and this movement is transferred to both compressor pistons 2040*a-b*. When hydraulic piston 2020 moves towards left, it may push compressor piston 2040*a* in an extension stroke into front chamber 2046*a*. The air within front chamber 2046*a* may be compressed and as a result the air pressure in front chamber 2046*a* increases. When the air pressure in front chamber 2046*a* exceeds the air pressure in rod chamber 2048*a*, one-way valve 20416*a* may open opening 20414*a* and may allow compressed air to flow from front chamber 2046*a* into rod chamber 2048*a* until the air pressure in front chamber 2046*a* is not higher that air pressure in rod chamber 2048*a* anymore. Concurrently, when hydraulic piston 2020 moves towards left, it may drag compressor piston 2040*b* in a retraction stroke toward rod chamber 2048*b*. Intake one-way valve 20412*b* may open opening 20410*b* under a suction force created by the retraction stroke of compressor piston 2040*b* and ambient air may enter front chamber 2046*b*.

Referring to FIG. 2B, as discussed above, in an exemplary embodiment, the reciprocating movement of hydraulic piston 2020 within hydraulic cylinder 2022 may drive reciprocating motions of compressor pistons 2040*a-b* within their respective compression cylinders 2044*a-b*. The reciprocating motions of compressor pistons 2040*a-b* within compression cylinders 2044*a-b* may allow for reciprocating air compressors 204*a-b* to compress air and a user may have access to this compressed air via air outlet port 2066.

Figure 3A:
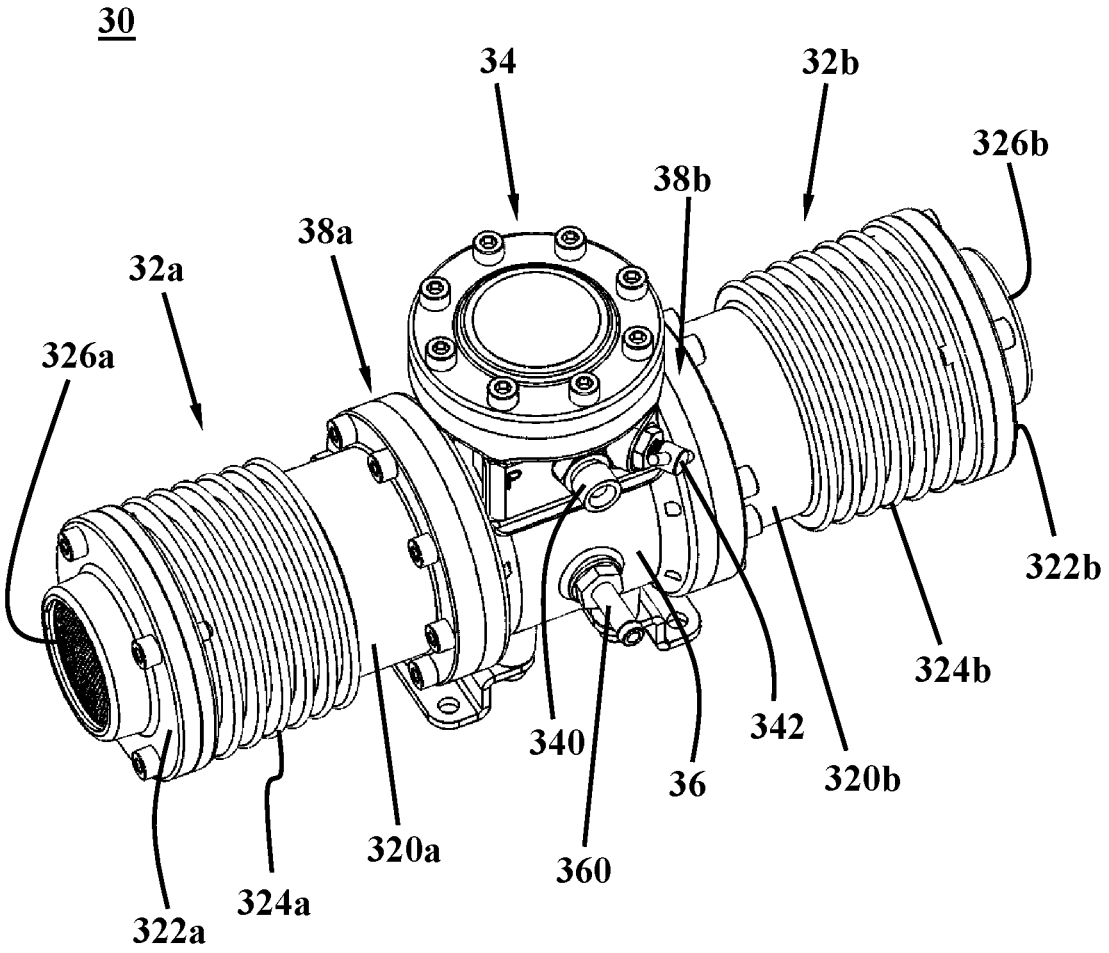
FIG. 3A illustrates a perspective view of a hydraulic-powered air compressor, consistent with one or more exemplary embodiments of the present disclosure.

FIG. 3A illustrates a perspective view of a hydraulic-powered air compressor 30, consistent with one or more exemplary embodiments of the present disclosure. In an exemplary embodiment, hydraulic-powered air compressor 30 may be similar to hydraulic-powered air compressor system 10 of FIG. 1 and hydraulic-powered air compressor 20 of FIGS. 2A-2C.

Referring to FIGS. 1 and 3A, in an exemplary embodiment, hydraulic-powered air compressor 30 may include at least one air compressor, for example reciprocating air compressors 32*a-b* that may be similar to air compressors 16*a-b* attached to a hydraulic actuation mechanism 34 that may be similar to hydraulic actuation mechanism 14. In an exemplary embodiment, hydraulic actuation mechanism 34 may be configured to drive reciprocating air compressors 32*a-b*. Hydraulic actuation mechanism 34 may be connected in fluid communication with a hydraulic power system of a vehicle such as a tractor similar to hydraulic power system 12. Pressurized hydraulic oil may be received within hydraulic actuation mechanism 34 from the hydraulic power system via a pressurized oil inlet port 340. In an exemplary embodiment, pressurized oil inlet port 340 may be controlled by a throttle valve 342 similar to throttle valve 18. Throttle valve 342 may be utilized to regulate the power of hydraulic actuation mechanism 34 by restricting the pressurized oil flow into hydraulic actuation mechanism 34.

In an exemplary embodiment, hydraulic-powered air compressor 30 may further include a housing 36 similar to housing 206 that may be utilized for accumulating compressed air provided by reciprocating air compressors 32*a-b*. In an exemplary embodiment, housing 36 may be equipped by a compressed air outlet port 360 similar to compressed air outlet port 2066. In an exemplary embodiment, reciprocating air compressors may be connected to either side of housing 36 by flange connections 38*a-b*.

In an exemplary embodiment, each reciprocating air compressor, for example air compressor 32*a* may include a compression cylinder 320*a* where a compressor cap 322*a* may be attached onto compression cylinder 320*a*. In an exemplary embodiment, compression cylinder 320*a* may further include fins 324*a* that may be formed or attached on an outer surface of compression cylinder 320*a*. Fins 324*a* may function as a heat sink that may help remove heat from compression cylinder 320*a*. In an exemplary embodiment, compressor cap 322*a* may include an ambient air inlet 326*a* that may allow ambient air to be sucked into compression cylinder 320*a* as will be described later in this disclosure.

In an exemplary embodiment, air compressor 32*b* may be structured similarly to air compressor 32*a* and may include a compression cylinder 320*b* where a compressor cap 322*b* may be bolted onto compression cylinder 320*b*. In an exemplary embodiment, compression cylinder 320*b* may further include fins 324*b* that may be formed or attached on an outer surface of compression cylinder 320*b*. Fins 324*b* may function as a heat sink that may help remove heat from compression cylinder 320*b*. In an exemplary embodiment, compressor cap 322*b* may include an ambient air inlet 326*b* that may allow ambient air to be sucked into compression cylinder 320*b*.

Figure 3B:
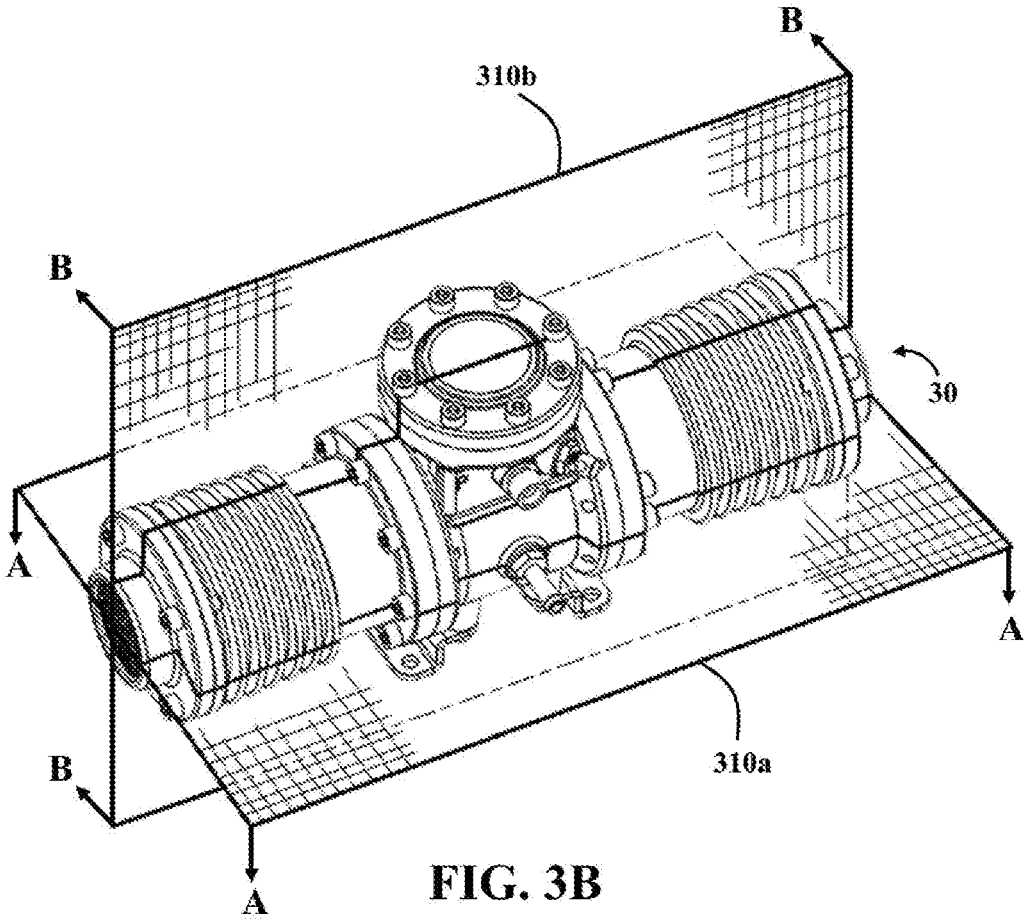
FIG. 3B illustrates a perspective view of a hydraulic-powered air compressor with a horizontal cutting plane and a vertical cutting plane, consistent with one or more exemplary embodiments of the present disclosure.
Figure 3C:
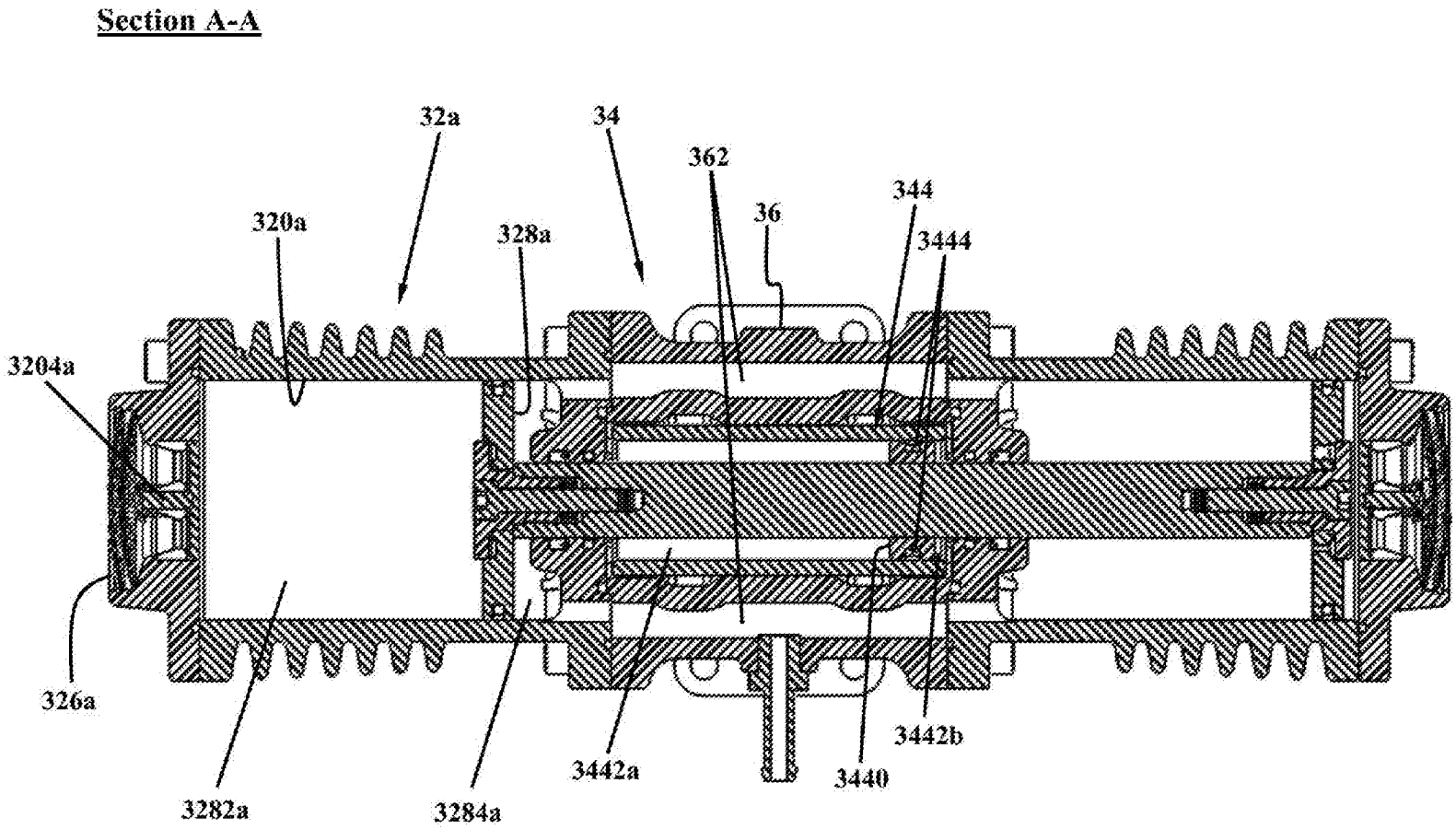
FIG. 3C illustrates a sectional top-view of a hydraulic-powered air compressor cut along a horizontal cutting plane, consistent with one or more exemplary embodiments of the present disclosure.
Figure 3D:
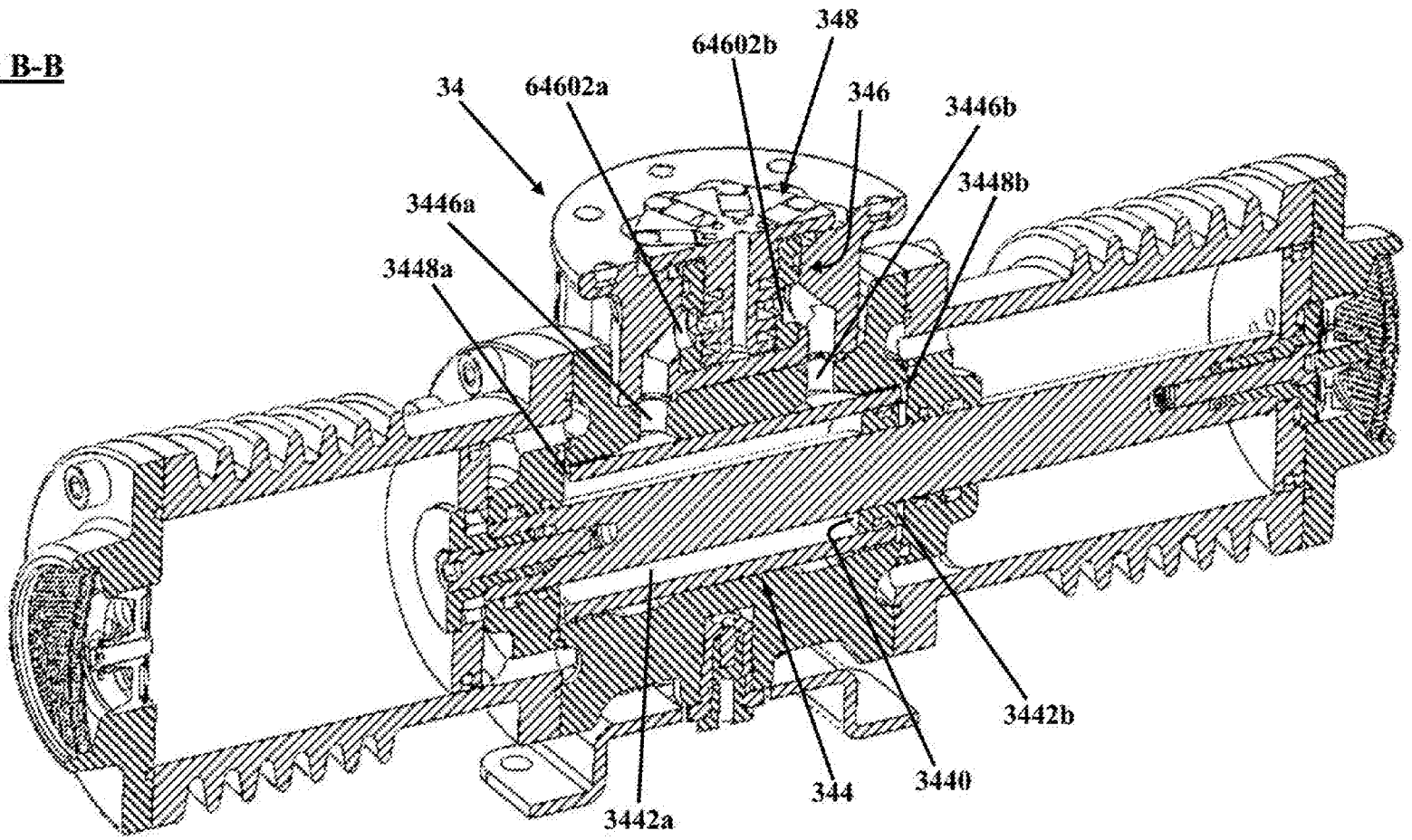
FIG. 3D illustrates a sectional perspective view of a hydraulic-powered air compressor cut along a vertical cutting plane, consistent with one or more exemplary embodiments of the present disclosure.

FIG. 3B illustrates a perspective view of hydraulic-powered air compressor 30 with a horizontal cutting plane 310*a* and a vertical cutting plane 310*b*, consistent with one or more exemplary embodiments of the present disclosure. FIG. 3C illustrates a sectional top-view of hydraulic-powered air compressor 30 cut along horizontal cutting plane 310*a*, consistent with one or more exemplary embodiments of the present disclosure, and FIG. 3D illustrates a sectional perspective view of hydraulic-powered air compressor 30 cut along vertical cutting plane 310*b*, consistent with one or more exemplary embodiments of the present disclosure. Referring to FIGS. 3B and 3C, section A-A of hydraulic-powered air compressor 30 that is cut by horizontal cutting plane 310*a* is illustrated in FIG. 3C. Referring to FIGS. 3B and 3D, section B-B of hydraulic-powered air compressor 30 that is cut by vertical cutting plane 310*b* is illustrated in FIG. 3D.

Referring to FIGS. 3A and 3C, in an exemplary embodiment, hydraulic actuation mechanism 34 may include a double-acting hydraulic cylinder 344 that may be coaxially disposed within housing 36. In an exemplary embodiment, a diameter of double-acting hydraulic cylinder 344 may be smaller than a diameter of housing 36 and a hollow space 362 may be formed between an internal surface of housing 36 and an external surface of hydraulic cylinder 344. In an exemplary embodiment, a profile of hollow space 362 may be similar to hollow space 2060. As used herein, the profile may refer to a shape of hollow space 362 when viewed from front. In an exemplary embodiment, double-acting hydraulic cylinder 344 may be similar to double-acting hydraulic cylinder 202 and housing 36 may be similar to housing 206.

In an exemplary embodiment, double-acting hydraulic cylinder 344 may include a hydraulic piston 3440 similar to hydraulic piston 2020 that may be disposed movably within double-acting hydraulic cylinder 344. In an exemplary embodiment, hydraulic piston 3440 may divide an interior of double-acting hydraulic cylinder 344 into a first chamber 3442*a* and a second chamber 3442*b* that may be separated in an oil-tight manner by hydraulic piston 3440. In an exemplary embodiment, first chamber 3442*a* and second chamber 3442*b* being separated in an oil-tight manner means that hydraulic oil may not pass from around hydraulic piston 3440 between first chamber 3442*a* and second chamber 3442*b*. For example, a sealing member such as an O-ring 3444 may be accommodated in a peripheral groove formed in an outer sliding surface of hydraulic piston 3440 to prevent hydraulic oil leaks around hydraulic piston 3440. In an exemplary embodiment, a reciprocating motion of hydraulic piston 3440 within double-acting hydraulic cylinder 344 may be actuated by alternately pumping pressurized hydraulic oil into first chamber 3442*a* and second chamber 3442*b*.

Referring to FIGS. 2B and 3D, in an exemplary embodiment, double-acting hydraulic cylinder 344 may include cylinder ports 3446*a-b* similar to cylinder ports 2024*a-b*. In an exemplary embodiment, cylinder ports 3446*a-b* may respectively be connected in fluid communication with first chamber 3442*a* and second chamber 3442*b* via slits 3448*a-b*. In an exemplary embodiment, hydraulic actuation mechanism 34 may further include a hydraulic directional control valve 346 that may be similar to hydraulic directional control valve 142.

Figure 4A:
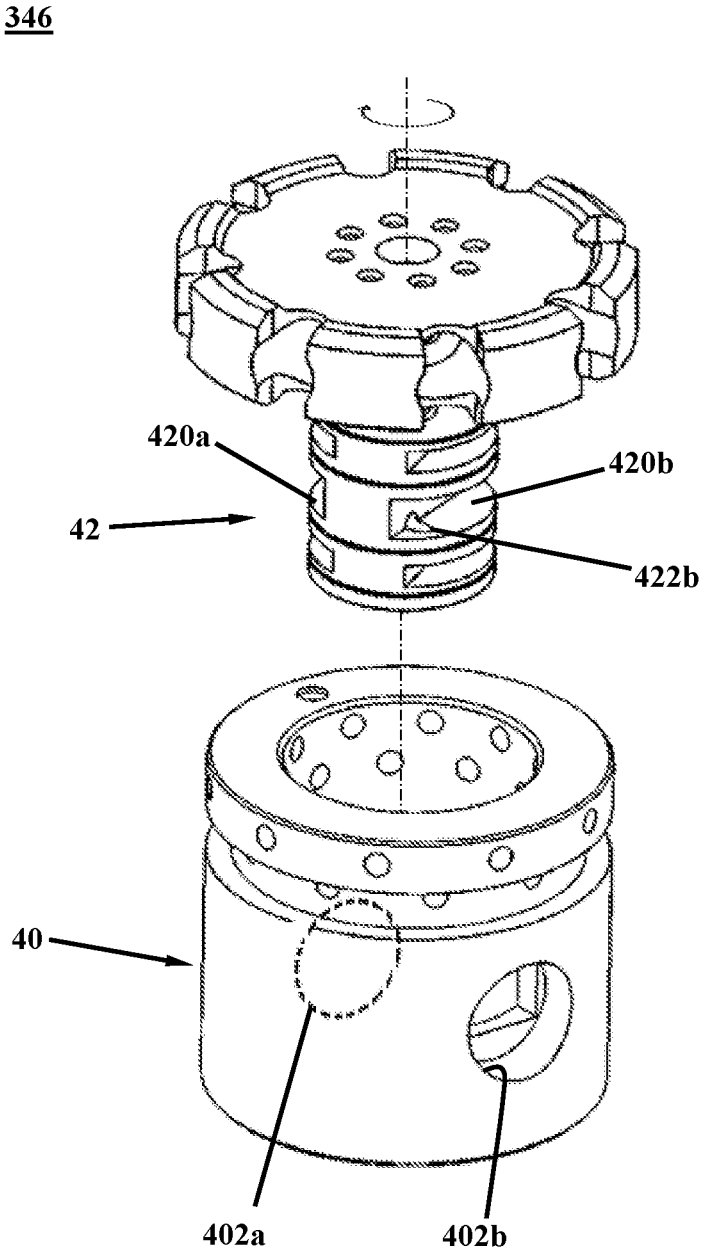
FIG. 4A illustrates an exploded perspective view of a hydraulic directional control valve, consistent with one or more exemplary embodiments of the present disclosure.
Figure 4B:
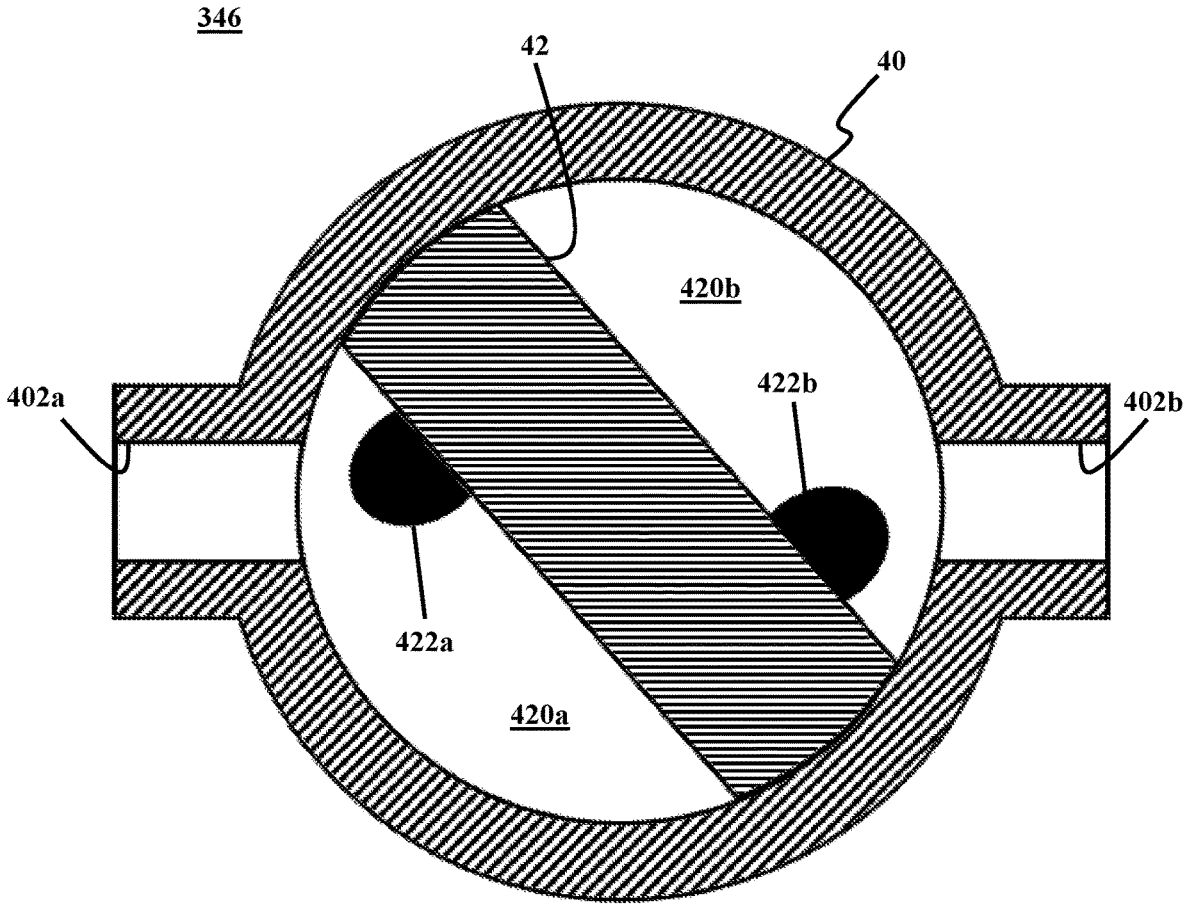
FIG. 4B illustrates a schematic top view of a hydraulic directional control valve, consistent with one or more exemplary embodiments of the present disclosure.

FIG. 4A illustrates an exploded perspective view of hydraulic directional control valve 346, consistent with one or more exemplary embodiments of the present disclosure and FIG. 4B illustrates a schematic top view of hydraulic directional control valve 346, consistent with one or more exemplary embodiments of the present disclosure.

Referring to FIGS. 3D, 4A and 4B, in an exemplary embodiment, hydraulic directional control valve 346 may be a rotary directional valve that may include a cylindrical valve housing 40 and a valve element 42 that may be rotatably mounted in cylindrical valve housing 40. In an exemplary embodiment, cylindrical valve housing 40 may include two working ports 402*a-b* similar to working ports 1422*a-b* that may be oppositely disposed along a periphery of cylindrical valve housing 40. In an exemplary embodiment, working port 402*a* may be connected in fluid communication with cylinder port 3446*a* and working port 402*b* may be connected in fluid communication with cylinder port 3446*b*.

In an exemplary embodiment, valve element 42 may include at least two recesses 420*a-b* that may be oppositely disposed along a periphery of valve element 42. In an exemplary embodiment, heights of recesses 420*a-b* may correspond to that of working ports 402*a-b* in cylindrical valve housing 40. In an exemplary embodiment, recess 420*a* may include a flow channel 422*a* that may be a pressure port connected in fluid communication with a pump similar to pump 120 of hydraulic power system 12. Recess 420*b* may include a flow channel 422*b* that may be a tank port connected in fluid communication with a tank similar to tank 124 of hydraulic power system 12.

In an exemplary embodiment, valve element 42 may have a rotational motion within stationary cylindrical valve housing 40 and when valve element 42 rotates, recesses 420*a-b* may alternately be placed in front of working ports 402*a-b*. As shown in FIG. 4B, in an exemplary embodiment, in a first half of rotational motion of valve element 42, recess 420*a* may be in front of working port 402*a* and flow channel 422*a* may be placed in fluid communication with working port 402*a* and pressurized hydraulic oil may be sent from flow channel 422*a* into working port 402*a*. While recess 420*b* may be in front of working port 402*b* and flow channel 422*b* may be placed in fluid communication with working port 402*b* and pressurized hydraulic oil may be sent from working port 402*b* into flow channel 422*b*.

In an exemplary embodiment, in a second half of rotational motion of valve element 42, recess 420*a* may be in front of working port 402*b* and flow channel 422*a* may be placed in fluid communication with working port 402*b* and pressurized hydraulic oil may be sent from flow channel 422*a* into working port 402*b*. While recess 420*b* may be in front of working port 402*a* and flow channel 422*b* may be placed in fluid communication with working port 402*a* and pressurized hydraulic oil may be sent from working port 402*a* into flow channel 422*b*. In exemplary embodiments, such arrangement of recesses 420*a-b* and working ports 402*a-b* may allow for alternately connecting working ports 402*a-b* to a tank line or a pressure line. This way, hydraulic directional control valve 346 may help drive the reciprocating motion of hydraulic piston 3440 within double-acting hydraulic cylinder 344 by alternately sending pressurized hydraulic oil into first chamber 3442*a* and second chamber 3442*b*.

In an exemplary embodiment, hydraulic actuation mechanism 34 may further include a hydraulic motor 348 similar to hydraulic motor 140 that may be coupled to or attached to valve element 42 of hydraulic directional control valve 346 and may be configured to drive a rotational motion of valve element 42 within cylindrical valve housing 40.

Figure 5A:
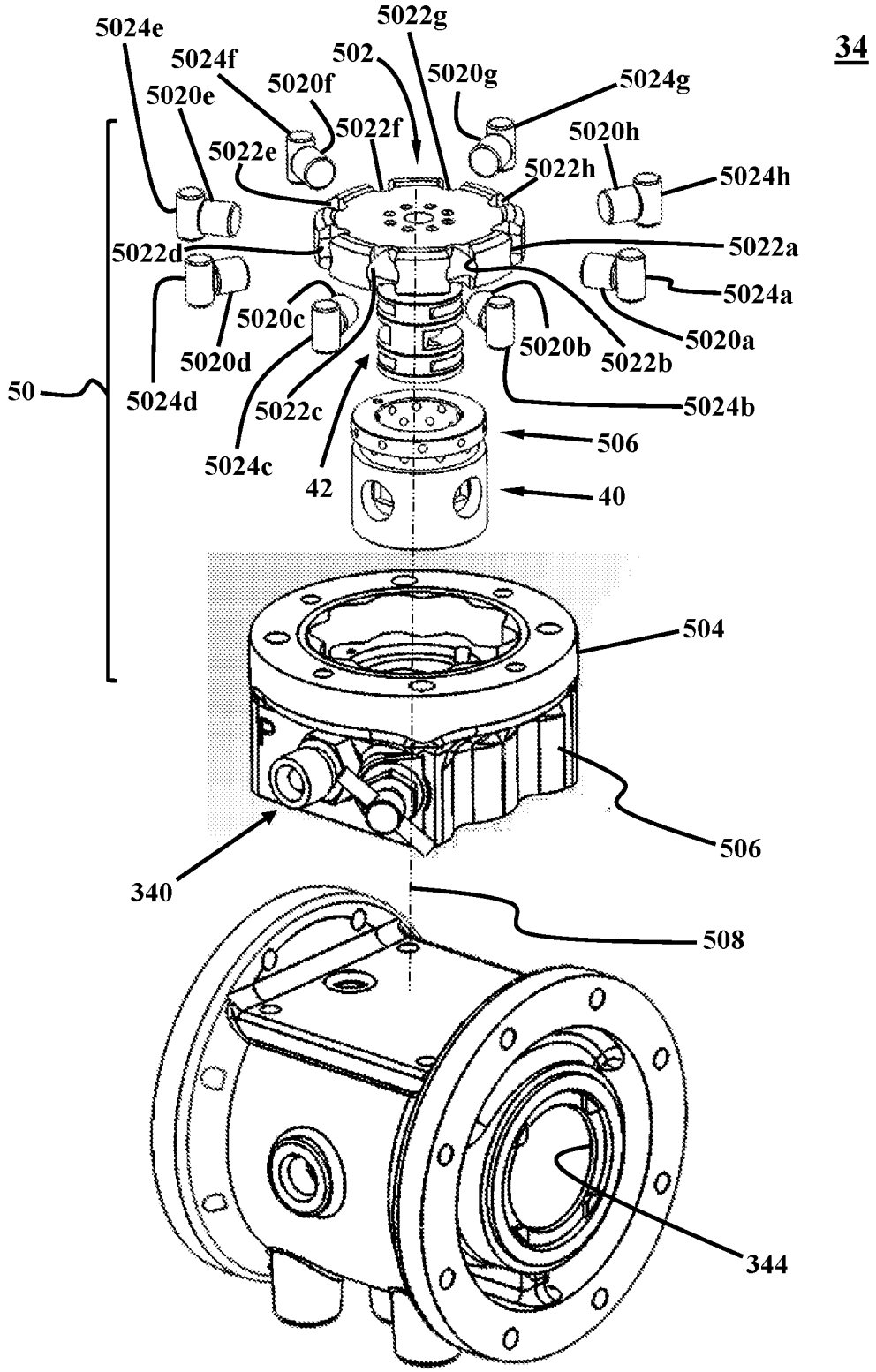
FIG. 5A illustrates an exploded view of a hydraulic actuation mechanism, consistent with one or more exemplary embodiments of the present disclosure.
Figure 5B:
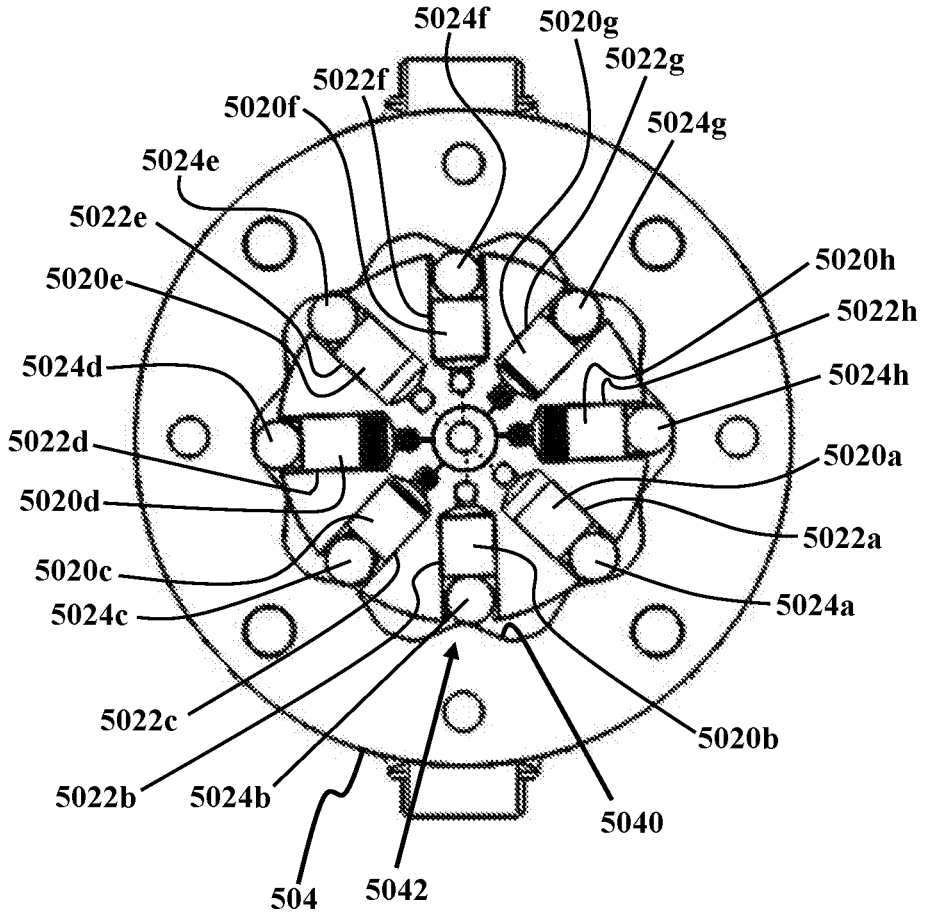
FIG. 5B illustrates a schematic top-view of a hydraulic radial piston rotary motor, consistent with one or more exemplary embodiment of the present disclosure.

FIG. 5A illustrates an exploded view of hydraulic actuation mechanism 34, consistent with one or more exemplary embodiments of the present disclosure, and FIG. 5B illustrates a schematic top-view of a hydraulic radial piston rotary motor 50, consistent with one or more exemplary embodiment of the present disclosure.

Referring to FIGS. 5A and 5B, in an exemplary embodiment, hydraulic actuation mechanism 34 may include a hydraulic radial piston rotary motor 50 similar to hydraulic motor 348 of FIG. 3D. In an exemplary embodiment, hydraulic radial piston rotary motor 50 may include a cylinder block 502 attached to and rotatable with valve element 42, a stationary cam disc 504 in which cylinder block 502 may be rotatably mounted, and a distributor valve 506 integrally formed with cylindrical valve housing 40.

In an exemplary embodiment, cylinder block 502 may include one or more pistons such as pistons 5020*a-h* that are slidably disposed within one or more radially-oriented cylinders such as cylinders 5022*a-h*. In an exemplary embodiment, pistons 5020*a-h* may be coupled with respective cam-follower rollers 5024*a-h* at their distal end. For example, piston 5020*a* may be coupled with cam-follower roller 5024*a* at a distal end 50202*a*. As used herein, a distal end of a piston may refer to an end of the piston close to an outer periphery 5026 of cylinder block 502.

In an exemplary embodiment, cam disc 504 may include an internal surface 5040 with one or more lobes, such as lobe 5042. In an exemplary embodiment, cam disc 504 may be mounted on a manifold housing 506 and valve element 42, distributor valve 506, and cylindrical valve housing 40, once assembled, may be disposed within manifold housing 506. In an exemplary embodiment, pressurized oil entering from pressurized oil inlet port 340 may be directed via a series of passageways controlled by distributor valve 506 into some of cylinders 5022*a-h*, for example, cylinders 5022*c*, 5022*d*, 5022*g*, and 5022*h*, and may urge corresponding pistons 5020*c*, 5020*d*, 5020*g*, and 5020*h* to have an extension stroke toward internal surface 5040. When pistons 5020*c*, 5020*d*, 5020*g*, and 5020*h* move in an extension stroke toward internal surface 5040, their respective cam-follower rollers 5024*c*, 5024*d*, 5024*g*, and 5024*h* push against internal surface 5040 and due to the presence of lobes, such as lobe 5042 on internal surface 5040, cam-follower rollers 5024*c*, 5024*d*, 5024*g*, and 5024*h* may roll down the lobes and cause cylinder block 502 to rotate about axis 508.

In an exemplary embodiment, the rest of cam-follower rollers, for example cam-follower rollers 5024*a*, 5024*b*, 5024*e*, and 5024*f* may roll up the lobes and urge their respective pistons 5020*a*, 5020*b*, 5020*e*, and 5020*f* to move outwardly in retraction strokes and discharge the oil in their corresponding cylinders 5022*a*, 5022*b*, 5022*e*, and 5022*f* via a series of passageways controlled by distributor valve 506 toward flow channel 422*a*. In an exemplary embodiment, at the end of the extension stroke of each piston, the shape of internal surface 5040 of cam disc 504 urges the piston to return to its starting position by undergoing a retraction stroke and discharging the oil within its respective cylinder. In exemplary embodiments, such configuration of distributor valve 506, cylinder block 502, and cam disc 504 that was described above may allow cylinder block 502 to have a continuous rotational movement about axis 508 which is then transferred to valve element 42. With further reference to FIGS. 3D and 4B, in an exemplary embodiment, when valve element 42 rotates within cylindrical valve housing 40, it alternately connects flow channel 422*a* in fluid communication with working ports 402*a-b* and as a result the pressurized oil may be alternately directed into first chamber 3442*a* and second chamber 3442*b* of double-acting hydraulic cylinder 344 and may cause the reciprocating motion of hydraulic piston 3440 within double-acting hydraulic cylinder 344

Referring to FIGS. 2A and 3C, in an exemplary embodiment, each reciprocating air compressor, for example, reciprocating air compressor 32*a* may include a compressor piston assembly 328*a* similar to compressor piston 2040*a* that may be moveably disposed within compression cylinder 320*a* and may have a reciprocating motion within compression cylinder 320*a*. In an exemplary embodiment, opposite sides of compressor piston assembly 328*a* may respectively define a front chamber 3282*a* and a rod chamber 3284*a* in an interior of compression cylinder 320*a*. In an exemplary embodiment, compression cylinder 320*a* may include air intake port 326*a* similar to air intake port 20410*a* that may open into front chamber 3282*a* and may be controlled by an intake one-way valve 3204*a* similar to intake one-way valve 20412*a*. Intake one-way valve 3204*a* may be configured to allow ambient air to be drawn from surrounding environment into front chamber 3282*a* and prevent compressed air from leaking out from front chamber 3282*a* into surrounding environment.

Figure 6A:
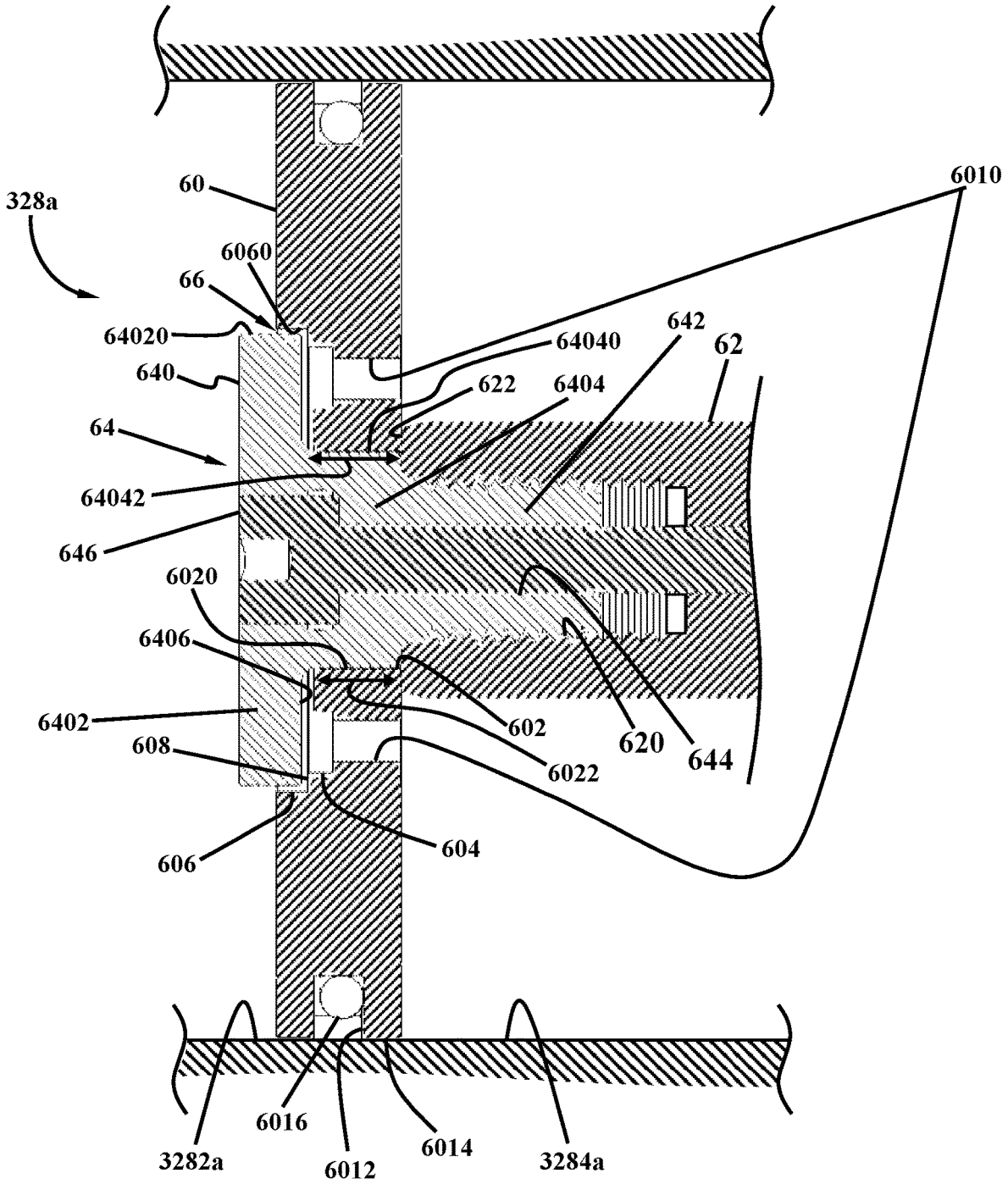
FIG. 6A illustrates a sectional side-view of a compressor piston assembly in an open-valve position, consistent with one or more exemplary embodiments of the present disclosure.
Figure 6B:
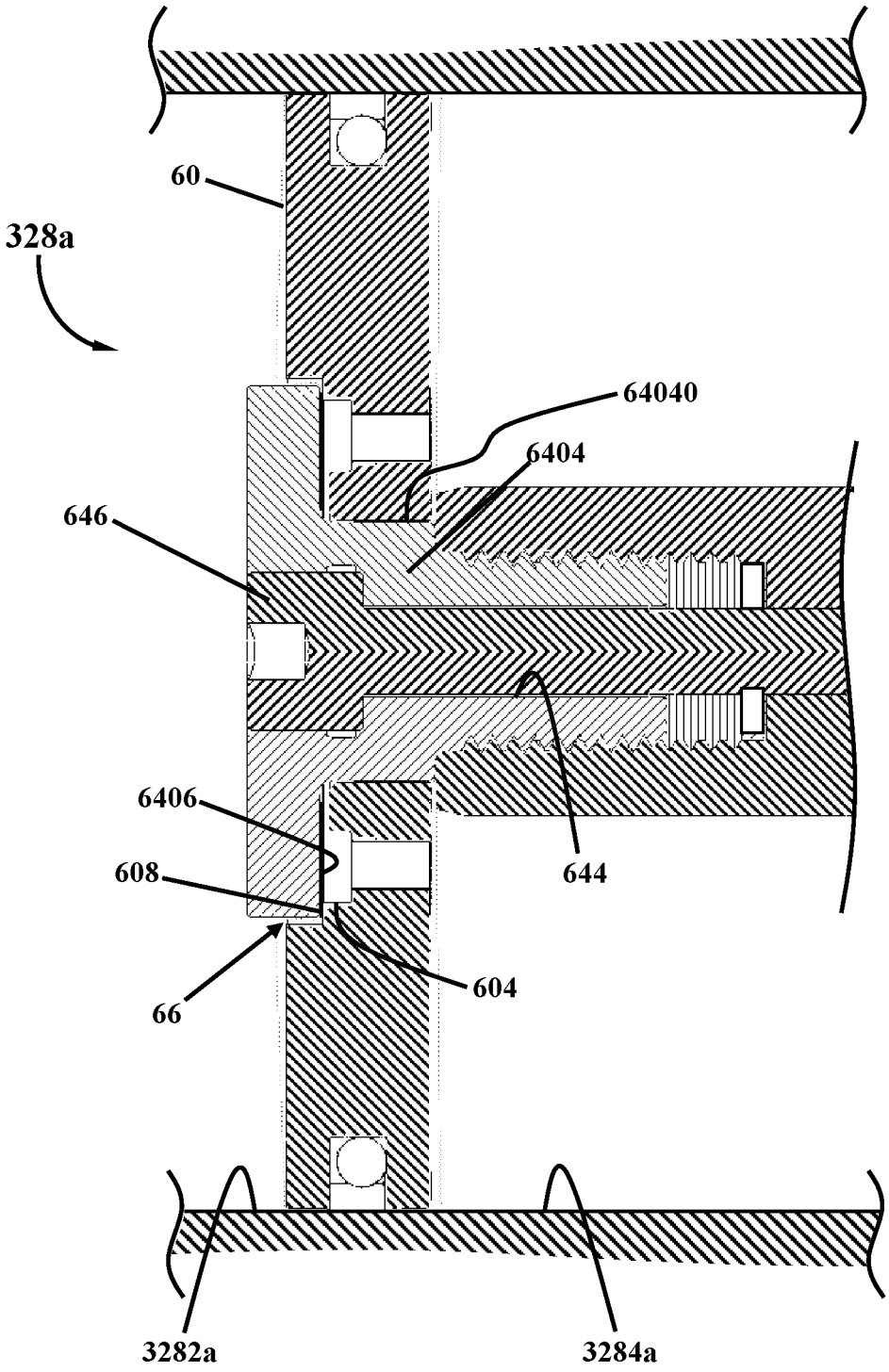
FIG. 6B illustrates a sectional side-view of a piston assembly in a closed-valve position, consistent with one or more exemplary embodiments of the present disclosure.
Figure 6C:
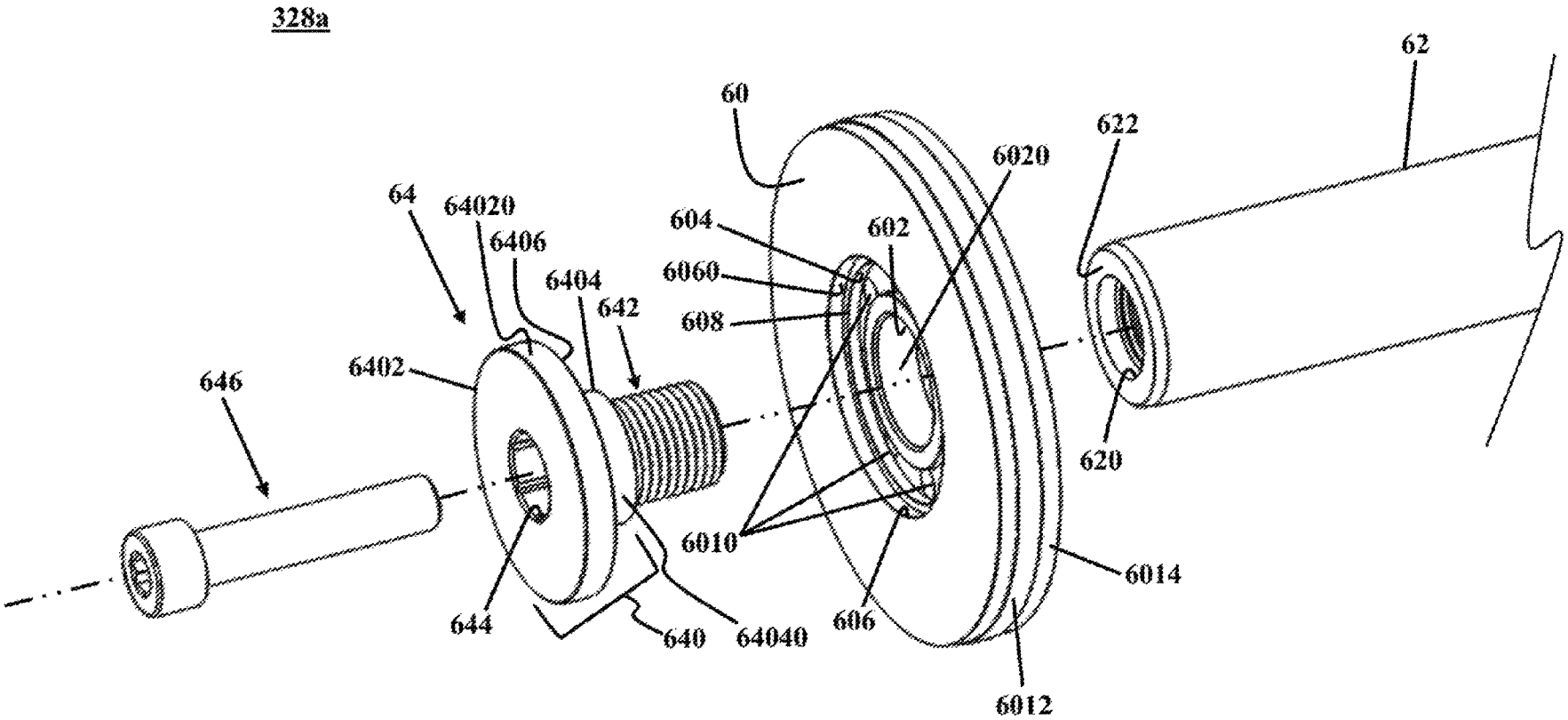
FIG. 6C illustrates an exploded view of a piston assembly, consistent with one or more exemplary embodiments of the present disclosure.

FIG. 6A illustrates a sectional side-view of compressor piston assembly 328*a* in an open-valve position, consistent with one or more exemplary embodiments of the present disclosure. FIG. 6B illustrates a sectional side-view of piston assembly 328*a* in a closed-valve position, consistent with one or more exemplary embodiments of the present disclosure. FIG. 6C illustrates an exploded view of piston assembly 328*a*, consistent with one or more exemplary embodiments of the present disclosure.

Referring to FIGS. 6A-6C, in an exemplary embodiment, piston assembly 328*a* may include a piston 60, a piston rod 62, and a valve member 64. In an exemplary embodiment, piston 60 may be a disc-shaped piston with a circular recess 606, and a central hole 602 and an annular recess 604 within and concentric with circular recess 606. Circular recess 606 may have a larger diameter than annular recess 604 and as a result an annular valve seat 608 is formed at the boundary between annular recess 604 and circular recess 606. In an exemplary embodiment, annular recess 604 may include one or more apertures 6010 that may connect annular recess 604 in fluid communication with rod chamber 3284*a*. One or more apertures 6010 may be arranged circularly around central hole 602.

In an exemplary embodiment, piston 60 may further include a peripheral groove 6012 formed in an outer sliding surface 6014 of piston 60, in which a sealing member such as an O-ring 6016 may be accommodated to prevent air to pass around piston 60.

In an exemplary embodiment, valve member 64 may include a valve disc 640 attached to or integrally formed with a valve stem 642. In an exemplary embodiment, valve disc 640 may include a larger-diameter disc portion 6402 and a smaller-diameter disc portion 6404 such that an engagement step 6406 is formed at the boundary between larger-diameter disc portion 6402 and smaller-diameter disc portion 6404. Smaller-diameter disc portion 6404 may slidably fit through central hole 602 while a diameter of larger-diameter disc portion 6402 is slightly smaller than a diameter of circular recess 606 such that when larger-diameter disc portion 6402 seats within circular recess 606, there is an annular slit 66 between an outer peripheral surface 64020 of larger-diameter disc portion 6402 and an inner peripheral surface 6060 of circular recess 606.

In an exemplary embodiment, valve stem 642 may be an annular rod with a threaded outer surface that may be tightly screwed into piston rod 62 and may attach valve member 64 to piston rod 62 firmly in position such that valve member 64 may not move or rotate with respect to piston rod 62. In an exemplary embodiment, piston rod 62 may include a longitudinal hole 620 that may be internally threaded and valve stem 642 may be screwed tightly within longitudinal hole 620.

In an exemplary embodiment, when valve stem 642 is tightly screwed into longitudinal hole 620, an inner surface 6020 of central hole 602 may slidably fit over an outer surface 64040 of smaller-diameter disc portion 6404. In an exemplary embodiment, a length 6022 of inner surface 6020 of central hole 602 may be slightly smaller than a length 64042 of outer surface 64040 of smaller-diameter disc portion 6404 and such a configuration allows piston 60 to slightly slide over outer surface 64040 of smaller-diameter disc portion 6404 between an open-valve position where piston 60 is tightly pressed against a distal surface 622 of piston rod 62 (as shown in FIG. 6A) and a closed-valve position where piston 60 is tightly pressed against engagement step 6406 (as shown in FIG. 6B).

Referring to FIG. 6A, in an exemplary embodiment, when an air pressure within front chamber 3282*a* is higher than an air pressure in rod chamber 3284*a*, higher air pressure in front chamber 3282*a* urges piston 60 to slide over outer surface 64040 of smaller-diameter disc portion 6404 to open-valve position. In open-valve position, piston 60 is tightly pressed against distal surface 622 of piston rod 62 such that there is a space between engagement step 6406 and annular valve seat 608 and a fluid communication may be established between annular slit 66 and annular recess 604 and as a result pressurized air in front chamber 3282*a* may pass through slit into annular recess 604 and then through one or more apertures 6010 into rod chamber 3284*a*.

Referring to FIG. 6B, in an exemplary embodiment, when air pressure within rod chamber 3284*a* is larger than air pressure in front chamber 3282*a*, higher air pressure in rod chamber 3284*a* may urge piston 60 to slide over outer surface 64040 of smaller-diameter disc portion 6404 to closed-valve position. In closed-valve position, piston 60 is tightly pressed against engagement step 6406 such that engagement step 6406 may rest upon annular valve seat 608 such that there is no fluid communication between annular slit 66 and annular recess 604 and as a result there is no fluid communication between front chamber 3282*a* and rod chamber 3284*a*.

Referring to FIGS. 6A-6C, in an exemplary embodiment, valve member 64 may further include a central hole 644 through which a locking screw 646 may further tightly lock valve member 64 in position with respect to piston rod 62. In exemplary embodiments, locking screw 646 may prevent valve stem 642 from getting loose within longitudinal hole 620.

While the foregoing has described what are considered to be the best mode and/or other examples, it is understood that various modifications may be made therein and that the subject matter disclosed herein may be implemented in various forms and examples, and that the teachings may be applied in numerous applications, only some of which have been described herein. It is intended by the following claims to claim any and all applications, modifications and variations that fall within the true scope of the present teachings.

Unless otherwise stated, all measurements, values, ratings, positions, magnitudes, sizes, and other specifications that are set forth in this specification, including in the claims that follow, are approximate, not exact. They are intended to have a reasonable range that is consistent with the functions to which they relate and with what is customary in the art to which they pertain.

The scope of protection is limited solely by the claims that now follow. That scope is intended and should be interpreted to be as broad as is consistent with the ordinary meaning of the language that is used in the claims when interpreted in light of this specification and the prosecution history that follows and to encompass all structural and functional equivalents. Notwithstanding, none of the claims are intended to embrace subject matter that fails to satisfy the requirement of Sections 101, 102, or 103 of the Patent Act, nor should they be interpreted in such a way. Any unintended embracement of such subject matter is hereby disclaimed.

Except as stated immediately above, nothing that has been stated or illustrated is intended or should be interpreted to cause a dedication of any component, step, feature, object, benefit, advantage, or equivalent to the public, regardless of whether it is or is not recited in the claims.

It will be understood that the terms and expressions used herein have the ordinary meaning as is accorded to such terms and expressions with respect to their corresponding respective areas of inquiry and study except where specific meanings have otherwise been set forth herein. Relational terms such as first and second and the like may be used solely to distinguish one entity or action from another without necessarily requiring or implying any actual such relationship or order between such entities or actions. The terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "a" or "an" does not, without further constraints, preclude the existence of additional identical elements in the process, method, article, or apparatus that comprises the element.

The Abstract of the Disclosure is provided to allow the reader to quickly ascertain the nature of the technical disclosure. It is submitted with the understanding that it will not be used to interpret or limit the scope or meaning of the claims. In addition, in the foregoing Detailed Description, it can be seen that various features are grouped together in various implementations. This is for purposes of streamlining the disclosure, and is not to be interpreted as reflecting an intention that the claimed implementations require more features than are expressly recited in each claim. Rather, as the following claims reflect, inventive subject matter lies in less than all features of a single disclosed implementation. Thus, the following claims are hereby incorporated into the Detailed Description, with each claim standing on its own as a separately claimed subject matter.

While various implementations have been described, the description is intended to be exemplary, rather than limiting and it will be apparent to those of ordinary skill in the art that many more implementations and implementations are possible that are within the scope of the implementations. Although many possible combinations of features are shown in the accompanying figures and discussed in this detailed description, many other combinations of the disclosed features are possible. Any feature of any implementation may be used in combination with or substituted for any other feature or element in any other implementation unless specifically restricted. Therefore, it will be understood that any of the features shown and/or discussed in the present disclosure may be implemented together in any suitable combination. Accordingly, the implementations are not to be restricted except in light of the attached claims and their equivalents. Also, various modifications and changes may be made within the scope of the attached claims.

What is claimed is:

1. A portable hydraulic-powered air compressor system detachably connected to a hydraulic power system of a vehicle, the air compressor system comprising:

a reciprocating compressor comprising:

a compression cylinder; and a compressor piston assembly movably disposed within the compression cylinder, opposite sides of the compressor piston assembly respectively defining a rod chamber and a front chamber in an interior of the compression cylinder, the front chamber comprising an air intake port, the compressor piston assembly comprising: a compressor piston slidably mounted within the compression cylinder, the compressor piston comprising a disc-shaped piston with a circular recess and a central hole within the circular recess concentric with the circular recess, the disc-shaped piston further comprising an annular recess between an outer periphery of the central hole and an inner periphery of the central recess such that an annular step is formed at a boundary between the annular recess and the circular recess, the annular recess comprising at least one aperture connected in fluid communication with the rod chamber; and a valve disc comprising a larger-diameter disc portion and a smaller-diameter disc portion attached to a disc stem, the disc-shaped piston mounted on the smaller-diameter disc portion between the larger-diameter disc portion and the disc stem, an inner surface of the central hole slidably encompassing an outer surface of the smaller-diameter disc, the disc stem coupled with the piston rod, wherein a length of the outer surface of the smaller-diameter disc portion is larger than a length of the inner surface of the central hole and the disc-shaped piston configured to be slidable over the outer surface of the smaller-diameter disc portion between a first position and a second position along an axis parallel to the piston rod responsive to an air pressure difference between the front chamber and the rod chamber; and a hydraulic motor detachably connected to the hydraulic power system, the hydraulic motor coupled to a piston rod of the compressor piston, the hydraulic motor configured to drive a reciprocating motion of the compressor piston within the compression cylinder.

2. The system according to claim 1, wherein the disc stem comprises an externally threaded rod and the piston rod comprises an internally threaded annular rod, wherein the disc stem is tightly screwed into the piston rod.

3. The system according to claim 1, wherein the air intake port is controlled by a one-way valve, the one-way valve configured to allow ambient air to be drawn into the front chamber via the air intake port and to prevent compressed air to be discharged out of the front chamber via the air intake port.

4. The system according to claim 1, wherein the larger-diameter disc portion is placed within the circular recess, a diameter of the larger diameter-disc portion smaller than a diameter of the circular recess forming a circular slit between an outer periphery of the larger-diameter disc portion and an inner periphery of the circular recess.

5. The system according to claim 4, wherein the disc-shaped piston moves to the second position responsive to an air pressure within the front chamber being higher than an air pressure within the rod chamber, in the second position the larger-diameter disc portion placed within the circular recess disengaged from the annular step with the circular slit connecting the annular recess and the front chamber in fluid communication.

6. The system according to claim 4, wherein the disc-shaped piston moves to the first position responsive to an air pressure within the rod chamber being higher than an air pressure within the front chamber, in the first position the larger-diameter disc portion placed within the circular recess tightly pressed against and engaged with the annular step at the boundary between the annular recess and the circular recess disconnecting a fluid communication between the annular recess and the front chamber.

7. A portable hydraulic-powered air compressor system detachably connected to a hydraulic power system of a vehicle, the air compressor system comprising:

a reciprocating compressor comprising:

a compression cylinder; and a compressor piston assembly movably disposed within the compression cylinder, opposite sides of the compressor piston assembly respectively defining a rod chamber and a front chamber in an interior of the compression cylinder, the front chamber comprising an air intake port, the compressor piston assembly comprising: a one-way valve, the one-way valve configured to fluidically connect the rod chamber and the front chamber responsive to an air pressure in the front chamber being higher than an air pressure in the rod chamber;

a directional control valve; and a double-acting cylinder connected in fluid communication with the hydraulic power system via the directional control valve, the double-acting cylinder comprising a hydraulic piston disposed within the double-acting cylinder, the hydraulic piston coupled to the piston rod of the compressor piston, the hydraulic piston configured to drive a reciprocating motion of the compressor piston within the compression cylinder, wherein the double-acting cylinder is coaxially disposed within a housing with a hollow space between an internal surface of the housing and the external surface of the double-acting cylinder, the hollow space connected in fluid communication with the rod chamber of the reciprocating compressor.

8. The system according to claim 7, wherein the hollow space further comprises a compressed air outlet port connected to an air hose for supplying compressed air to a user.

9. The system according to claim 7, wherein the hollow space comprises an unloading passageway controlled by a pressure relief valve, the pressure relief valve set at a predetermined value of pressure and configured to exhaust compressed air accumulated in the connected hollow space and the rod chamber via the unloading passageway responsive to an air pressure within the connected hollow space and the rod chamber being higher that the predetermined value of pressure.

10. The system according to claim 7, further comprising a hydraulic motor configured to be driven by the hydraulic power system of the vehicle, the hydraulic motor configured to actuate the directional control valve.

11. The system according to claim 10, wherein the hydraulic motor comprises a radial piston hydraulic motor.

12. The system according to claim 7, wherein opposite sides of the hydraulic piston respectively defining a first chamber and a second chamber in an interior of the double-acting cylinder, the hydraulic piston configured to be movable in two directions responsive to relative magnitudes of hydraulic oil pressure in the first chamber and the second chamber.

13. The system according to claim 12, wherein the directional control valve comprises:

a cylindrical valve housing, the cylindrical valve housing comprising a first working port and a second working port oppositely disposed along a periphery of the cylindrical valve housing, the first working port connected in fluid communication with the first chamber, the second working port connected in fluid communication with the second chamber; and a valve element rotatably and coaxially mounted within the cylindrical valve housing, the valve element comprising a cylindrical body with a first recess and a second recess oppositely disposed along a periphery of the cylindrical body, the valve element coupled to the radial-piston hydraulic motor.

14. The system according to claim 13, wherein the first recess comprises a first flow channel in fluid communication with an oil pump of the hydraulic power system of the vehicle via a pressure line and wherein the second recess comprises a second flow channel in fluid communication with an oil tank of the hydraulic power system of the vehicle via a tank line.

15. The system according to claim 14, wherein the radial-piston hydraulic motor is configured to drive a rotational movement of the valve element within the cylindrical valve housing alternately placing the first recess and the second recess in fluid communication with a corresponding one of the first working port and the second working port.

16. The system according to claim 15, wherein the air intake port is controlled by a one-way valve, the one-way valve configured to allow ambient air to be drawn into the front chamber via the air intake port and to prevent compressed air to be discharged out of the front chamber via the air intake port.

* * * * *